US005869420A

United States Patent [19]

Naito

[11] Patent Number: 5,869,420

[45] Date of Patent: Feb. 9, 1999

[54] REWRITABLE THERMAL RECORDING MEDIUM

[75] Inventor: Katsuyuki Naito, Tokyo, Japan

[73] Assignee: Kabushiki Kaisha Toshiba, Kawasaki, Japan

[21] Appl. No.: 674,861

[22] Filed: Jul. 3, 1996

[30] Foreign Application Priority Data

Jul. 5, 1995 [JP] Japan ..... 7-169390

[51] Int. Cl.[6] ..... B41M 5/34

[52] U.S. Cl. ..... 503/201; 503/208; 503/209; 503/216; 503/225

[58] Field of Search ..... 503/201, 208, 503/209, 214, 216, 225

[56] References Cited

U.S. PATENT DOCUMENTS 5,663,115 9/1997 Naito et al. ..... 503/201

FOREIGN PATENT DOCUMENTS 42 21 322 1/1993 Germany .
195 07 151 9/1995 Germany .

OTHER PUBLICATIONS

Patent Abstracts of Japan, JP 7–156540, Jun. 20, 1995.

*Primary Examiner*—Bruce H. Hess
*Attorney, Agent, or Firm*—Oblon, Spivak, McClelland, Maier & Neustadt, P.C.

[57] ABSTRACT

A rewritable thermal recording medium comprises a recording material containing a color former and a developer. Recording-erasing of information is performed on the basis of a change in the state of the recording material. The developer is formed of a compound capable of forming a liquid crystal phase and/or represented by general formula (I) given below $$(Y)_m Ar (X)_n R \quad (I)$$

wherein Ar denotes a noncondensed polycyclic structure consisting of a plurality of ring structures connected to each other via any of a single bond, a vinylene bond and an ethynylene bond or a condensation polycyclic structure, X denotes an ether bond, a thioether bond, an ester bond or an amide bond, Y is an acidic group, R is a substituted or unsubstituted alkyl group, a substituted or unsubstituted alkenyl group, or a substituted or unsubstituted alkynyl group, m is an integer of 1 to 3, and n is 0 or 1.

17 Claims, 3 Drawing Sheets

REWRITABLE THERMAL RECORDING MEDIUM

BACKGROUND OF THE INVENTION

1. Field of the Invention

The present invention relates to a rewritable thermal recording medium.

2. Description of the Related Art

In recent years, with the advance of office automation, the amount of various information has significantly increased, and the chances of information output have also been increased with increase in the information amount. In general, the information outputs are classified into a hard copy output from a printer to paper sheets and a display output. Unfortunately, in the hard copy output, a large quantity of paper is consumed as a recording medium with increase in the information output amount. Therefore, the hard copy output is expected to be a problem in the future in respect of protection of natural resources. On the other hand, the display output requires a large scale circuit board in a display unit. This brings about problems of portability and cost. For these reasons, a rewritable recording medium, which is free from the above-noted problems inherent in the conventional technique, is anticipated as a third recording medium.

Some recording materials for such a rewritable recording medium, which contains a color former such as a leuco dye and various acids acting as a developer, are certainly known to the art. In the conventional recording material of this type, a color development and decoloring are brought about by the interaction between the color former and the developer. For example, Japanese Patent Disclosure No. 4-50290 discloses recording materials which contain a leuco dye, an acid as a developer, and a long-chain amine as a decoloring agent, and in which heat energy is supplied to the recording material so as to repeatedly perform the chemical color development and decoloring. Additional recording materials, which contain a leuco dye and a long-chain phosphonic acid as a developer and in which the heat energy is controlled so as to change the crystal structure and, thus, to achieve reversible changes between the color developed state and the decolored state, are disclosed in, for example,"Pre-prints for 42nd Polymer Forum (1993, page 273)". Further,"Japan Hardcopy '93, pp 413–416" teaches an additional type of recording material, which contains a leuco dye and a long-chain 4-hydroxyanilide compound that is highly crystallizable and in which reversible changes between the color developed state and the decolored state are achieved, by supplying heat energy, on the basis of reversible changes between the crystalline state and amorphous state.

However, these recording materials require a very large activation energy for repeatedly performing the color development-decoloring functions, making it difficult to improve the recording-erasing speed in general. Where, for example, the color development and decoloring of the composition containing a color former and a developer are reversibly repeated on the basis of the transition between the crystalline state and the amorphous state, it is difficult to improve the recording-erasing speed, because the transition from the amorphous state, which is in a metastable nonequilibrium state, to the crystalline state, which is in a stable equilibrium state, takes a long time in general. On the other hand, where the composition is prepared simply in view of improvement in the speed of the transition from the amorphous state to the crystalline state, it is difficult to allow the composition to form an amorphous state of a long life. In other words, if it is intended to improve the recording-erasing speed in the conventional recording material containing a color former and a developer, the color developed state or the decolored state, whichever corresponds to the metastable nonequilibrium state, is rendered unstable. As a result, a change from the nonequilibrium state to the equilibrium state proceeds gradually even if a heat energy is not supplied form the outside to the recording medium, giving rise to reduction in the thermal stability of recording.

As described above, vigorous studies are being made on a rewritable thermal recording medium using a recording material containing a color former and a developer. In the conventional thermal recording medium, however, an improvement in the recording-erasing speed is contradictory to an improvement in the thermal stability of recording. Since it is difficult to satisfy these requirements simultaneously, a satisfactory rewritable thermal recording medium has not yet been put to a practical use.

SUMMARY OF THE INVENTION

An object of the present invention is to solve the above-noted problems inherent in the prior art so as to provide a rewritable thermal recording medium which permits improving the recording-erasing speed and exhibits a sufficiently high thermal stability of recording.

According to a first aspect of the present invention, there is provided a rewritable thermal recording medium, comprising a recording material containing a color former and a developer, wherein the developer has a polycyclic structure selected from the group consisting of a noncondensed polycyclic structure formed of a plurality of ring structures connected to each other via any of a single bond, a vinylene bond and an ethynylene bond and a condensed polycyclic structure, and substituent groups attached to the ring structures at the ends of the polycyclic structure, at least one of the substituent groups being an organic group having a hydrocarbon chain.

It is desirable to use a compound capable of forming a liquid crystal phase as the developer.

According to a second aspect of the present invention, there is provided a rewritable thermal recording medium, comprising a recording material containing at least a color former, a developer, and a matrix agent capable of forming a liquid crystal phase.

Further, according to a third aspect of the present invention, there is provided a rewritable thermal recording medium, in which recording-erasing of information is performed on the basis of a reversible change in the phase separation state of a recording material containing at least a color former, a developer, a phase separation controller serving to increase the phase separation speed, and, as desired, a matrix agent, the phase separation controller being capable of forming a liquid crystal phase.

In principle, the operation of the rewritable thermal recording medium of the present invention is based on the interaction between the color former and the developer contained in the recording material. What should be noted is that the particular interaction is controlled by controlling the reversible transition between the crystalline and amorphous states or by controlling the change in the phase separation state of the recording material. It is important to note that any of the developer, matrix agent and phase separation controller contained in the recording material should be formed of a compound capable of forming a liquid crystal phase.

DETAILED DESCRIPTION OF THE PREFERRED EMBODIMENTS

A rewritable thermal recording medium of the present invention comprises a recording material containing a color former, and a developer. In a general sense, the color former denotes a precursor compound of a coloring matter which forms a colored image, and a developer is a compound which serves to develop a color through an exchange of an electron or a proton with the color former. That is, the composition system of a color former and a developer generally develops a color when the interaction between the two increases and loses a color when the interaction decreases. For performing the recording-erasing of information in the rewritable thermal recording medium of the present invention, the interaction between the color former and the developer is controlled on the basis of the crystallographic or thermodynamic change in state of the recording material containing at least a color former and a developer, i.e., on the basis of a reversible transition between the crystalline state and the amorphous state or a change in the state of the phase separation.

Figure 1:
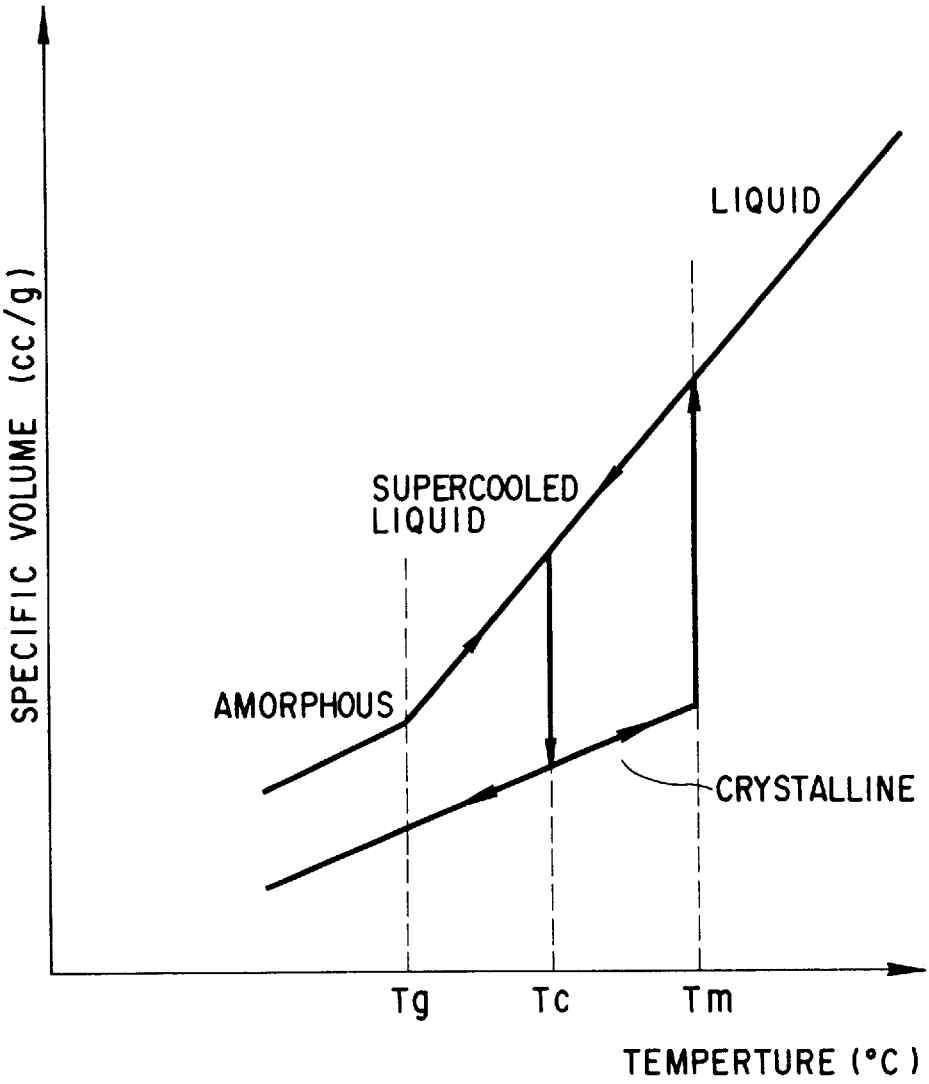
FIG. 1 shows the thermal characteristics of a recording material used in a rewritable thermal recording medium of the present invention.

Let us describe the transition between the crystalline and amorphous states of the recording material with reference to the thermal characteristics shown in FIG. 1. The drawing covers a recording material which forms a metastable amorphous state at room temperature. If the recording material in an amorphous state is heated to temperatures falling within a range of between the crystallization temperature Tc and the melting point Tm, followed by cooling the recording material, the material forms a stable crystalline state at temperatures lower than the glass transition temperature Tg. If the recording material in the crystalline state is heated again to temperatures higher than the melting point Tm, followed by subjecting the molten material to a rapid cooling or natural cooling to room temperature lower than the glass transition temperature Tg, the recording material is allowed to assume the amorphous state again. It follows that, in the recording material exhibiting the thermal characteristics as shown in FIG. 1, a reversible transition between the crystalline state and the amorphous state can be repeated by supplying heat energies of two different values, which permit heating the recording material to temperatures falling within a range of between the crystallization temperature Tc and the melting point Tm and to temperatures higher than the melting point Tm.

For example, where the recording material contains a color former and a developer, these color former and developer are uniformly mixed under the amorphous state of the recording material, with the result that the interaction between the two is increased so as to perform a color development. Under the crystalline state, the color former and the developer are phase-separated from each other, with the result that the interaction between the two is weakened so as to perform decoloring.

In the present invention, it is possible to add a matrix agent to the recording material containing a color former and a developer. The term "matrix agent" used herein denotes a compound which affects a reversible change in the state of the recording material. To be more specific, a recording material containing a color former, a developer, and a matrix agent is more likely to bring about the reversible change noted above than a material containing a color former and a developer alone. It is desirable for the matrix agent to dissolve preferentially the developer (or the color former). The particular property of the matrix agent permits easily changing the interaction between the color former and the developer, the interaction causing the color development and decoloring in the recording material.

A recording material containing a color former, a developer and a matrix agent is opposite in many cases in the recording-erasing mode to a material which does not contain a matrix agent. To be more specific, the color former and the developer are uniformly present within the matrix agent when the recording material is in an amorphous state, with the result that the interaction between the color former and the developer is weakened so as to perform the decoloring. On the other hand, the color former and the developer are segregated at grain boundaries of the matrix agent, when the recording material is in a crystalline state, so as to increase the interaction between the two and, thus, to achieve a color development. By contraries, it is possible in some cases that any of the color former and the developer forms a mixed crystal together with the matrix agent when the recording material is in a crystalline state. In this case, the mixed crystal phase is completely separated from the phase of the color former or the developer, which is not involved in the mixed phase. As a result, the interaction between the color former and the developer is weakened so as to put the recording material in a decolored state.

As described above, recording-erasing of information based on the transition between the crystalline state and the amorphous state can be performed by supplying heat energies of two different values to a recording material containing a color former, a developer and, as required, a matrix agent so as to heat the recording material to temperatures falling within a range of between the crystallization temperature Tc and the melting point Tm and to temperatures exceeding the melting point Tm. In this case, the crystalline state corresponds to a stable equilibrium state, with the amorphous state corresponding to a metastable nonequilibrium state.

To determine whether the composition used in the present invention is crystalline or amorphous, it is possible to employ general methods such as an X-ray diffractometry, an electron diffractometry and measurement of a light transmittance. When it comes to, for example, the X-ray diffractometry or electron diffractometry, sharp peaks or spots can be observed in the case of a crystalline composition, though such peaks or spots cannot be observed in the case of an amorphous composition. On the other hand, a light scattering of the composition can be evaluated when it comes to the measurement of a light transmittance. It should also be noted that, where the composition is polycrystalline, the light is scattered more strongly with decrease in the wavelength of the light, leading to a low light transmittance. It follows that the decrease in the light transmittance caused by the light scattering can be distinguished from the decrease in the light transmittance caused by the light absorption by looking into the dependence of the light transmittance on the wavelength of light, making it possible to estimate the grain diameter of the crystal.

In the rewritable thermal recording medium of the present invention, it is possible for the repetition of the phase transition between the crystalline state and the amorphous state to take place in the entire portion or some portion of the recording material in recording-erasing information. Also, it is possible for every component of the recording material to form a crystalline state individually. Alternatively, a plurality of components may collectively form a crystalline state. The X-ray diffractometry or electron diffractometry can also be employed for determining whether the repetition of transition between the crystalline state and the amorphous state takes place in the entire portion or some portion of the recording material. Specifically, since the peak or spot observed in the X-ray diffractometry or electron diffractometry has a pattern inherent in the particular component of the recording material, it is possible to specify the component which repeats the crystalline-to-amorphous transition within the recording material by analyzing the pattern of the peak or spot.

Figure 2:
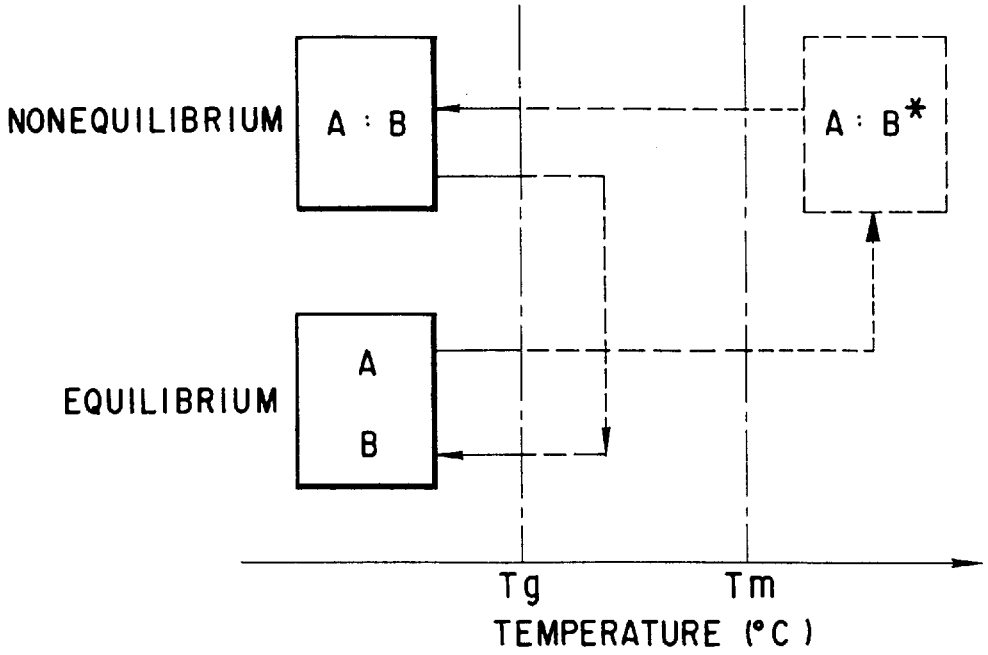
FIG. 2 shows how the state of a recording material is changed in a rewritable thermal recording medium of the present invention.

FIG. 2 schematically illustrates changes in the state of a recording material, covering the case where recording-erasing of information is performed on the basis of the change in the state of the phase separation in the recording material of two component system consisting of a color former A and a developer B. The colon ":" in FIG. 2 denotes the state of interaction between the two components of the recording material, with the asterisk "*" denoting a fluidized state. Further, the processes in the change of the phase separation state are denoted by straight lines. Specifically, the solid lines denote that the two component system is in a solid phase. On the other hand, the broken lines and the dotted lines denote that the two component system is in a supercooled liquid phase and an ordinary liquid phase, respectively.

In the two component system shown in FIG. 2, the condition that the phase of the color former A and the phase of the developer B are separated from each other constitutes the state of equilibrium at room temperature. Under this condition, the interaction between the color former A and the developer B is weak. If the recording material under this condition is heated to temperatures higher than the melting point Tm, a large interaction is generated between the fluidized color former A and developer B. If the molten recording material is cooled, preferably rapidly, to room temperature, the recording material is forcedly solidified, with the large interaction noted above left unchanged. As a result, the recording material is put under the condition of a metastable nonequilibrium. Such a state of nonequilibrium exhibits a long life under temperatures lower than the glass transition temperature Tg. It follows that the state of nonequilibrium can be retained over a sufficiently long period of time, if the glass transition temperature Tg of the recording material is not lower than room temperature.

If the recording material under the state of nonequilibrium is heated to temperatures higher than the glass transition temperature Tg, the diffusion speed of each of the color former A and the developer B is rapidly increased. As a result, the phase separation between the color former A and the developer B is promoted toward the state of equilibrium which is most stable. In general, it suffices to heat the recording material in this step to temperatures falling within a range between the crystallization temperature Tc and the melting point Tm of the recording material, though it is desirable to determine appropriately the heating temperature in this step in view of the diffusion speed of each of the components of the recording material and the heat source used. If the recording material, in which the phase of the color former A and the phase of the developer B are sufficiently separated from each other, is cooled again to room temperature, the recording material is brought back to the state of equilibrium in which the interaction between the color former A and the developer B is weak.

Figure 3:
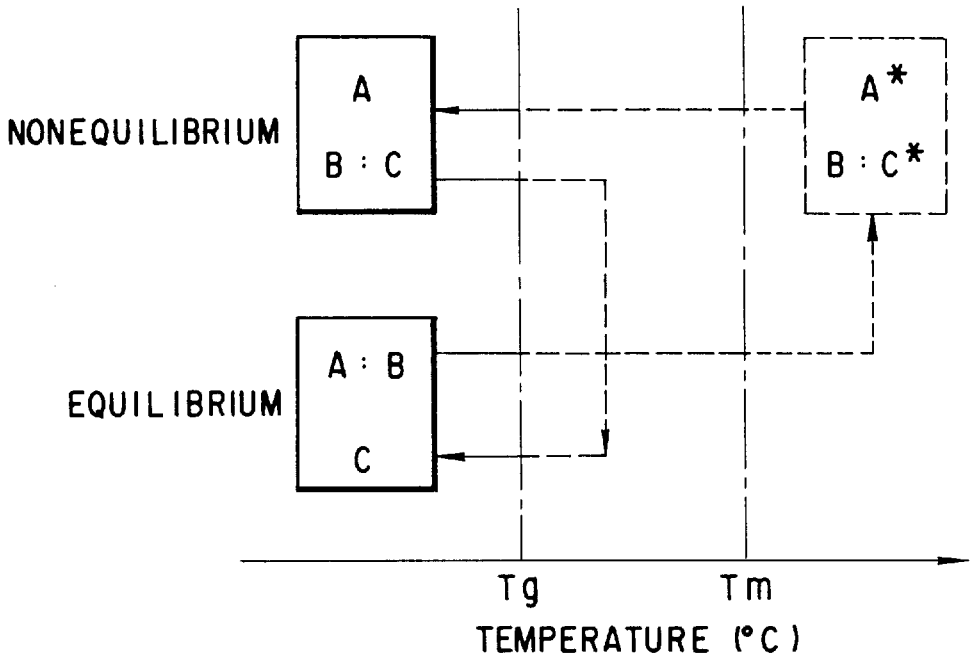
FIG. 3 shows how the state of another recording material is changed in a rewritable thermal recording medium of the present invention.

FIG. 3 schematically illustrates changes in the state of a recording material, covering the case where recording-erasing of information is performed on the basis of the change in the state of the phase separation in the recording material of three component system consisting of a color former A, a developer B, and a matrix agent C. The drawing is prepared on the assumption that the solubility of the developer B in the matrix agent C is markedly higher than that of the color former A in the matrix agent C under the molten state of the recording material.

In the recording material of the three component system shown in FIG. 3, the condition that the phase consisting of the color former A and the developer B is separated from the phase of the matrix agent C constitutes the state of equilibrium at room temperature. Under this condition, a large interaction takes place between the color former A and the developer B so as to achieve a color development. If the recording material under the state of equilibrium is heated to temperatures higher than the melting point Tm, the developer B is dissolved in the matrix agent C. However, the color former A is dissolved only slightly in the matrix agent C. Then, if the molten recording material is cooled to room temperature, preferably rapidly, to forcedly solidify the recording material, the developer B is taken into the matrix agent C in a large amount exceeding the equilibrium solubility. As a result, the recording material assumes a metastable state of nonequilibrium in which the interaction between the color former A and the developer B is lost so as to achieve decoloring. The state of nonequilibrium exhibits a long life under temperatures lower than the glass transition temperature Tg of the recording material. It follows that the state of nonequilibrium can be retained over a sufficiently long period of time, if the glass transition temperature Tg of the recording material is not lower than room temperature.

If the recording material under the state of nonequilibrium is heated to temperatures higher than the glass transition temperature Tg of the recording material, the diffusion speed of the developer B which has been taken into the matrix agent C is rapidly increased. As a result, the phase separation between the phase of the developer B and the phase of the matrix agent C is promoted toward the most stable state of equilibrium of the recording material. In general, it suffices to set the heating temperature in this step to fall within a range of between the crystallization temperature Tc and the melting point Tm of the recording material, though it is desirable to determine appropriately the heating temperature in view of the solubility of the developer B in the matrix agent C and heat source used. If cooled again to room temperature after a sufficient phase separation between the developer B and the matrix agent C, the recording material tends to be brought back to the equilibrium state. As a result, a large interaction is generated again between the color former A and the developer B so as to achieve a color development. It is possible in the present invention that, when the recording material is heated to temperatures higher than the melting point Tm so as to melt the recording material, the solubility of the color former in the matrix agent is higher than the solubility of the developer in the matrix agent. It is also possible that, after cooling of the recording material to room temperature, the color former is taken into the matrix agent in a large amount exceeding an equilibrium solubility.

Where the recording-erasing of information is performed on the basis of the change in the phase separation state of the recording material, it is effective to add a phase separation controller serving to increase the phase separation speed of the recording material in the rewritable thermal recording medium of the present invention. It is desirable to use as a phase separation controller a compound having a melting point lower than that of a two component system consisting of a color former and a developer or a three component system consisting of a color former, a developer, and a matrix agent. Also, the compound used as the phase separation controller should desirably be capable of dissolving at least one of the color former and the developer under temperatures lower than the melting point of the compound. Let us describe a recording material of four component system prepared by adding a phase separation controller to the material of the three component system shown in FIG. 3. In this case, the speed of phase separation between the developer and the matrix agent can be increased, as described in the following with reference to FIG. 4.

Figure 4:
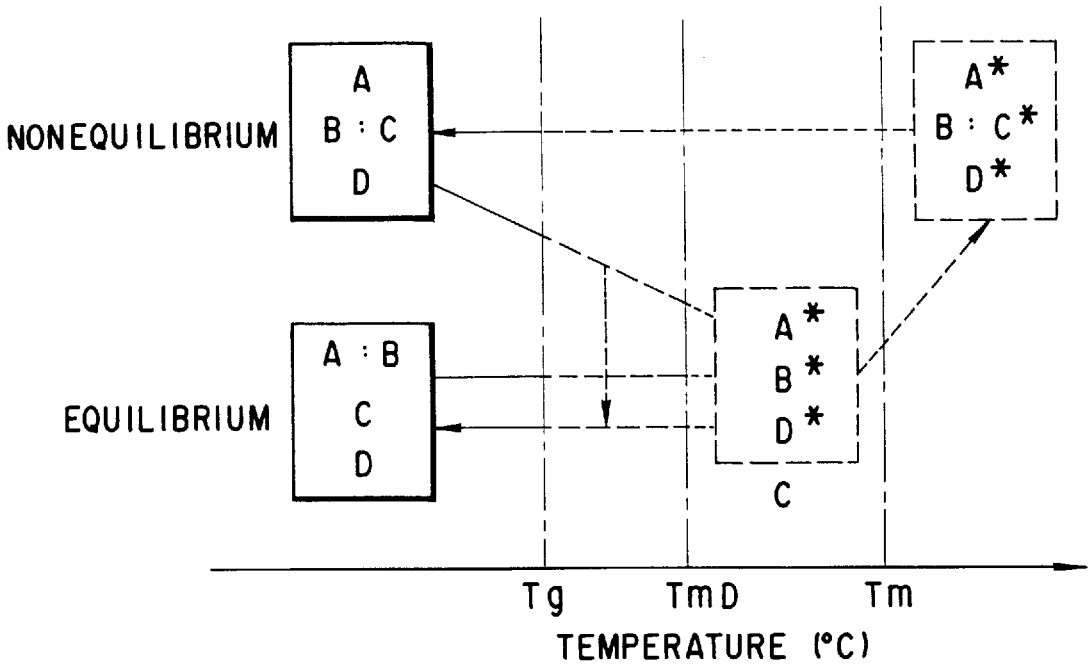
FIG. 4 shows how the state of still another recording material is changed in a rewritable thermal recording medium of the present invention.

Specifically, FIG. 4 schematically illustrates changes in the state of a recording material containing a color former A, a developer B, a matrix agent C, and a phase separation controller D, covering the case where recording-erasing of information is performed on the basis of the change in the state of the phase separation in the particular recording material.

In the recording material of the four component system shown in FIG. 4, the condition that the phase consisting of the color former A and the developer B is separated from the phase of the matrix agent C and from the phase of the phase separation controller D constitutes the state of equilibrium at room temperature. Under this condition, a large interaction takes place between the color former A and the developer B so as to achieve a color development. If the recording material under the state of equilibrium is heated to temperatures higher than the melting point Tm, the developer B is dissolved in the matrix agent C. However, the color former A is dissolved only slightly in the matrix agent C. Then, if the molten recording material is cooled to room temperature to forcedly solidify the recording material, the developer B is taken into the matrix agent C in a large amount exceeding the equilibrium solubility. As a result, the recording material assumes a metastable state of nonequilibrium in which the interaction between the color former A and the developer B is substantially lost so as to achieve decoloring. Particularly, the presence of the phase separation controller D permits the recording material to be capable of supercooling, with the result that the compatible system consisting of the matrix agent C and the phase separation controller D maintains a fluidity even under temperatures lower than the melting point Tm. It follows that the recording material is capable of assuming a metastable state of nonequilibrium even if the recording material is cooled slowly. The state of nonequilibrium exhibits a long life under temperatures lower than the glass transition temperature Tg of the recording material. It follows that the state of nonequilibrium can be retained over a sufficiently long period of time, if the glass transition temperature Tg of the recording material is not lower than room temperature.

If the recording material under the state of nonequilibrium is heated to temperatures exceeding the glass transition temperature Tg, the diffusion speed of the developer B is rapidly increased. As a result, the phase separation between the developer B and the matrix agent C is promoted toward the most stable state of equilibrium. If the recording material is further heated to temperatures higher than the melting point TmD of the phase separation controller D, the liquefied phase separation controller D dissolves the developer B and a portion of the matrix agent C. As a result, the diffusion speed of the developer B is drastically increased so as to markedly promote the phase separation between the developer B and the matrix agent C. If cooled again to room temperature after the sufficient phase separation between the developer B and the matrix agent C, the recording material is brought back to the equilibrium state. As a result, a large interaction is brought about again between the color former A and the developer B so as to achieve a color development.

As described above, the presence of the phase separation controller permits markedly increasing, for example, the speed of phase separation between the developer B and the matrix agent C. As a matter of fact, the speed of phase separation can be made $10^2$ to $10^4$ times as high as that of the three component system which does not contain the phase separation controller under temperatures in the vicinity of the glass transition temperature Tg of the recording material. The phase separation speed can be further increased to $10^3$ to $10^4$ times as high as that of the particular three component system under temperatures in the vicinity of the melting point TmD of the phase separation controller D.

Where the phase separation controller is added to a recording material of two component system consisting of a color former and a developer as shown in FIG. 2, the phase separation controller also permits increasing the speed of phase separation between the color former and the developer.

As described above, heat energies having two different values are supplied appropriately to the rewritable thermal recording medium of the present invention so as to reversibly repeat the change in the state of phase separation between two different phases of the recording material. As a result, the degree of interaction between the color former and the developer is changed so as to record or erase information. The change in the state of the phase separation noted above can be explained as a phenomenon which is generally known to the art as a spinodal decomposition or microphase separation.

In the present invention, a change in the state of the recording material takes place in the form of any of the transition between the crystalline and amorphous states and the change in the phase separation state, when a heat energy is supplied to the composition. Which type of the change in the state of the recording material to take place depends not only on the kinds and combination thereof of the color former, the developer, and the matrix agent contained in the recording material but also on the mixing ratio of these components. Incidentally, the type of change in the state of the recording material can be estimated on the basis of the change with time in the colored state of the recording material which takes place when the recording material in a metastable state of nonequilibrium is heated to temperatures higher than the glass transition point Tg to cause the recording material to be changed toward the state of equilibrium. To be more specific, a change with time in the reflection density or light transmittance is measured first, followed by obtaining therefrom a change with time in the colored state of the recording material. Where the color change follows the Arrhenius equation, a heat activation type reversible transition between the crystalline state and the amorphous state is considered to have taken place preferentially. Where the color change follows the Vogel-Fulcher equation, however, a change in the state of the phase separation is considered to have taken place preferentially. It should be noted in this connection that the reversible transition between the crystalline state and the amorphous state and the change in the state of the phase separation may take place simultaneously in some cases, though any of the reversible transition and the change in the state of the phase separation takes place independently in other cases in the recording material used in the rewritable thermal recording medium of the present invention.

In the present invention, recording-erasing of information can be performed on the basis of the reversible transition between the crystalline state and the amorphous state or the change in the state of the phase separation by giving two heat histories differing from each other in the cooling rate after the heating to temperatures higher than the melting point Tm in place of supplying heat energies of two different values to the recording material. To be more specific, if the recording material heated to temperatures higher than the melting point Tm is cooled rapidly to room temperature, the recording material is allowed to assume a metastable state of nonequilibrium. If cooled gradually, however, the recording material is allowed to assume a state of equilibrium. It follows that the transition between the crystalline state and the amorphous state or the change in the state of the phase separation can be repeated reversibly by suitably selecting any of the rapid cooling or gradual cooling in the cooling step so as to control as desired the intensity of the interaction between the color former and the developer. Further, a stress may be applied to the recording material, in place of supplying heat energies, in the process of change in the state of the recording material from the metastable state of nonequilibrium to the state of equilibrium.

To reiterate, the recording material used in the rewritable thermal recording medium of the present invention comprises a color former, a developer, a matrix agent, as desired, and a phase separation controller, as desired. As already described, any of the developer, the matrix agent and the phase separation controller should desirably be capable of forming a liquid crystal phase.

The color former used in the present invention includes electron-donating organic substances such as leucoauramines, diarylphthalides, polyarylcarbinols, acylauramines, arylauramines, Rhodamine B lactams, indolines, spiropyrans, fluorans, cyanine dyes and Crystal Violet, and electron-accepting organic substances such as phenolphthaleins.

To be more specific, the electron-donating organic substances include, for example, Crystal Violet lactone (CVL), Malachite Green lactone, Crystal Violet carbinol, Malachite Green carbinol, N-(2,3-dichlorophenyl)leucoauramine, N-benzoylauramine, Rhodamine B lactam, N-acetylauramine, N-phenylauramine, 2-(phenylimino ethanediylidene)-3,3-dimethylindoline, N-3,3-trimethylindolinobenzospiropyran, 8'-methoxy-N-3,3-trimethylindolinobenzospiropyran, 3-diethylamino-6-methyl-7-chlorofluoran, 3-diethylamino-7-methoxyfluoran, 3-diethylamino-6-benzyloxyfluoran, 1,2-benzo-6-diethylaminofluoran, 3,6-di-p-toluidino-4,5-dimethylfluoran, phenylhydrazide-γ-lactam, and 3-amino-5-methyl fluoran. 2-anilino-6-(N-cyclohexyl-N-methylamino)-3-methylfluoran, 2-anilino-3-methyl-6-(N-methyl-N-propylamino)fluoran, 3-[4-(4-phenylaminophenyl) aminophenyl] amino-6-methyl-7-chlorofluoran, 2-anilino-6-(N-methyl-N-isobutylamino)-3-methylfluoran, 2-anilino-6-(dibutylamino)-3-methylfluoran, 3-chloro-6-(cyclohexylamino)fluoran, 2-chloro-6-(diethylamino) fluoran, 7-(N,N-dibenzylamino)-3-(N,N-diethylamino) fluoran, 3,6-bis(diethylamino)fluoran-γ-(4'-nitroanilino) lactam, and 3-diethylaminobenzo [a]-fluoran.

On the other hand, the electron-accepting organic substances used in the present invention include, for example, phenolphthalein, tetrabromophenolphthalein, phenolphthalein ethyl ester, and tetrabromophenolphthalein ethyl ester.

The color former compounds exemplified above can be used singly or in the form of a mixture of a plurality of different compounds. In the present invention, a multicolored image can be obtained because the colored states in various colors can be attained by properly choosing the color formers. Of the above compounds, cyanine dyes and Crystal Violet sometimes lose a color when the interaction with the developer is increased, and develop a color when the interaction is decreased.

Where an electron-donating organic substance is used as the color former, the developer used in the present invention includes acidic compounds such as phenols, phenol metal salts, carboxylic acid, metal carboxylates, sulfonic acids, sulfonates, phosphoric acids, metal phosphates, acidic phosphoric esters, acidic phosphoric ester metal salts, phosphorous acids, and metal phosphites. On the other hand, where an electron-accepting organic substance is used as the color former, it is desirable to use a basic compound such as amines as the developer. Among the above developers, phenols and phenol metal salts are especially preferable because a recording medium containing a developer selected from them represents a high reflection density and a high stability in a color developed state as well as can easily repeat changes between a color developed state and decolored state. Examples of developers used in combination with color formers such as cyanine dyes and crystal Violet, which serve to allow a decolored state as the interaction between them is decreased and allow a color developed state as the interaction is increased, are sulfonic acids, sulfonates, phosphoric acids, metal phosphates, acidic phosphoric esters, acidic phosphoric ester metal salts, phosphorous acids, and metal phosphites. These compounds can be used singly or in the form of a mixture consisting of a plurality of different compounds.

The matrix agent used in the present invention should desirably be capable of easily forming a colorless, good amorphous state. If the matrix agent is capable of forming a colorless and transparent amorphous state, the contrast ratio between the printed portion and the background can be increased. The matrix agent meeting the particular requirement can be provided by a compound having a large molecular weight, being small in an enthalpy change of melting $\Delta H$ of the crystal per weight and, thus, being low in its maximum crystal growth velocity (MCV). If the crystal of the matrix agent has a small enthalpy change of melting $\Delta H$, the heat energy required for melting the crystal is decreased, leading to an energy saving. Under the circumstances, it is desirable to use as the matrix agent a compound having a bulky molecular skeleton close to a spherical form such as the steroid skeleton.

By contraries, a low molecular compound having a molecular weight of less than 100 is unsuitable for use as a matrix agent in the present invention because such a low molecular compound is large in its enthalpy change of melting $\Delta H$ and unlikely to form an amorphous state. Likewise, linear long-chain alkyl derivatives and planar aromatic compounds are unsuitable for use as a matrix agent, even if these compounds have a molecular weight of 100 or more. On the other hand, a compound having a plurality of sites at which intermolecular hydrogen bonds can be formed has a substantially large molecular weight, even if the compound itself has a low molecular weight or the enthalpy change of melting $\Delta H$ of the crystal of the compound is large to some extent. It follows that the particular compound is capable of easily forming an amorphous phase and, thus, can be used as a matrix agent in the present invention. The substituents capable of an intermolecular hydrogen bond formation include, for example, hydroxyl group, primary and secondary amino groups, primary and secondary amide bonds, urethane bond, urea bond, hydrazone bond, hydrazine group, and carboxyl group. In other words, it is desirable to use as the matrix agent a compound having a plurality of substituents exemplified above. On the other hand, a compound forming an intramolecular hydrogen bond is unsuitable for use in the present invention as a matrix agent, even if the compound has a plurality of sites at which hydrogen bonds can be formed.

In view of the requirements described above, it is desirable to use sterols as a matrix agent. Specific sterols which can be used in the present invention include, for example, cholesterol, stigmasterol, pregnenolone, methylandrostenediol, estradiol benzoate, epiandrostene, stenolone, β-citosterol, pregnenolone acetate, β-cholestanol, 5,16-pregnadiene-3β-ol-20-one, 5-α-pregnene-3β-ol-20-one, 5-pregnene-3 β, 17-diol-20-one 21-acetate, 5-pregnene-3 β, 17-diol-20-one 17-acetate, 5-pregnene-3 β, 17-diol-20-one 21-acetate, 5-pregnene-3 β, 17-diol diacetate, rockogenin, tigogenin, esmilagenin, hecogenin, diosgenin, and derivative thereof. These matrix agents can be used singly or a plurality of these compounds can be used together in the form of a mixture.

Where the recording-erasing is performed in the rewritable thermal recording medium of the present invention on the basis of a reversible transition of the recording material between the crystalline state and the amorphous state, it is desirable for the matrix agent itself to be capable of repetition of a reversible transition between the crystalline state and the amorphous state. However, it is not absolutely necessary for the matrix agent alone to be capable of repetition of a reversible transition between the crystalline state and the amorphous state as far as the matrix agent is combined with the color former or the developer so as to reversibly repeat the particular transition. In other words, the maximum crystal growth velocity (MCV) and the maximum crystal growing temperature Tc, max of the recording material can be controlled in the present invention by suitably choosing the color former or the developer which is used in combination with the matrix agent. Further, it is possible for a plurality of different compounds to perform the function of the matrix agent, when mixed together.

As already described, the matrix agent used in the present invention should desirably be capable of preferentially dissolving one of the color former and the developer, e.g., the developer, in the melting step of the recording material. If the matrix agent preferentially dissolves the developer, the interaction between the color former and the developer can be prominently weakened when the recording material is made amorphous by cooling so as to decrease the color density in a decolored state, leading to an improved contrast ratio between the printed portion and the background. Also, if the amorphous state is colorless and highly transparent, the printing on the underlayer can be recognized. For improving the solubility of the developer in the matrix agent, it is desirable to use a matrix agent which is highly compatible with the developer. The matrix agent meeting the particular requirement can be provided by a compound capable of forming a hydrogen bond with, for example, the developer. Specifically, it is desirable to use compounds having a polar group such as alcohols, thiols, carboxylic acids, carboxylates, phosphates, sulfonates, sulfides, disulfides, sulfoxides, sulfones, and carbonates. These compounds can be used singly or in the form of a mixture of different compounds.

In the present invention, it is desirable to use as a phase separation controller a low molecular organic material that is highly crystallizable, the organic material having a hydrocarbon group having at least 8 carbon atoms together with a polar group such as a hydroxyl group, a carbonyl group, an ester group or a carboxyl group. The organic materials meeting these requirements include, for example, linear higher monohydric alcohols, linear higher polyhydric alcohols, linear higher monovalent fatty acids, linear higher polyvalent fatty acids, esters thereof, ethers thereof, linear higher ketones, linear higher fatty acid amides and linear higher polyvalent fatty acid amides.

To be more specific, the organic materials which can be used in the present invention as the phase separation controller include, for example, linear monohydric higher alcohols such as 1-docosanol, 1-tetracosanol, 1-hexacosanol, and 1-octacosanol; linear polyhydric higher alcohols such as 1,12-dodecane diol, 1,14-tetradecane diol, 1,15-pentadecane diol, 1,16-hexadecane diol, 1,17-heptadecane diol, 1,18-octadecane diol, 1,19-nonadecane diol, 1,20-eicosadecane diol, 1,21-heneicosane diol, 1,22-docosane diol, 1,23-tricosane diol, 1,24-tetracosane diol, 1,12-octadecane diol, 1,2-tetradecane diol, and 1,2-hexadecanediol; linear monovalent higher fatty acids such as behenic acid, 1-docosanoic acid, 1-tetracosanoic acid, 1-hexacosanoic acid, and 1-octacosanoic acid; linear polyvalent higher fatty acids such as dodecanedioic acid, and 1,12-dodecane dicarboxylic acid; linear higher ketones such as stearone; linear higher fatty acid alcohol amides such as isopropanolamide stearate, isopropanolamide behenate, and hexanolamide behenate; and linear higher fatty acid diol diesters such as ethyleglycol dilaurate, catechol dilaurate, and cyclohexanediol dilaurate. These compounds can be used singly or in the form of a mixture of different compounds. A mixture which can be used as the phase separation controller can be chosen from an ester-based wax, an alcohol-based wax and an urethane-based wax.

In order to increase the recording-erasing speed, the phase separation controller should desirably be capable of supercooling. In other words, a difference between the melting point and the solidifying point of the phase separation controller should desirably be at least 10° C. In order to improve the thermal stability of recording in the thermal recording medium of the present invention, the phase separation controller should desirably have a melting point not lower than 60° C.

In addition to the general materials which have already been described in respect of the color former, the developer, the matrix agent, and the phase separation controller, it is also possible to use in the present invention LC-type compounds, i.e., compounds capable of forming a liquid crystal or compounds possessing a liquid-crystal-like molecular structure, as a developer, a matrix agent, and a phase separation controller.

Where the recording material used in the present invention contains an LC-type compound, the change from the metastable state of nonequilibrium to the state of equilibrium can be brought about in a short time. Suppose the recording-erasing of information is performed on the basis of transition of the recording material from the crystalline state to the amorphous state. If the recording material containing an LC-type compound is heated from the amorphous state, which is in the metastable state of nonequilibrium, to temperatures exceeding the crystallization temperature Tc, the recording material readily forms a state having a high degree of order such as a liquid crystal phase. It follows that it is possible to decrease the potential energy in crystallizing the recording material under the above state, making it possible to achieve the crystallization in a short time. A similar effect can also be obtained where the recording-erasing of information is performed on the basis of the change in the phase separation state of the recording material. Specifically, if the recording material is heated to temperatures exceeding the crystallization temperature Tc, the LC-type compound forms a state having a high degree of order. At the same time, the diffusion speed of the color former or the developer is increased. As a result, the phase separation speed of the recording material is increased. It follows that the potential energy between the two phase separation states is decreased so as to permit the change between these two states to be achieved in a short time. In addition, since the LC-type compound exhibits a large intermolecular attractive force and a high thermal stability, the recording material containing an LC-type compound exhibits a sufficiently high thermal stability even under an amorphous state.

In order to increase the recording-erasing speed, the LC-type compound used as a developer, a matrix agent or a phase separation controller should desirably be capable of forming a liquid crystal phase in the form of a supercooled liquid under temperatures lower than the melting point, because the transition between the liquid crystal phase and the crystalline state is performed in a very short time. In view of the thermal stability of the recording material under the state of nonequilibrium, the LC-type compound should be capable of forming a liquid crystal phase at temperatures not lower than 25° C., preferably not lower than 60° C., though the crystallization temperature of the LC-type compound is not particularly limited where the recording medium is used for a special purpose at room temperature or lower.

It is not absolutely necessary for the LC-type compound used in the present invention to form a liquid crystal phase. In other words, the recording-erasing speed can be increased, as far as the LC-type compound permits forming a state having a high degree of order to some extent. It should be noted, however, that, where the LC-type compound forms a liquid crystal phase at high temperatures exceeding 200° C., a large energy is required for heating the recording material to permit the LC-type compound to be fluidized sufficiently in performing the recording-erasing of information, resulting in failure to achieve a sufficient energy saving. Incidentally, the recording-erasing speed can be further improved, if an electric field or a magnetic field is applied to the recording material while supplying a heat energy to the recording material when the recording material is heated for forming a liquid crystal layer.

Let us describe the LC-type compounds, i.e., compounds capable of forming liquid crystal phases, suitable for use in the present invention as a developer, a matrix agent or a phase separation controller.

Specifically, the LC-type compound used as a developer in the present invention should have a polycyclic structure including selected from the group consisting of a noncondensed polycyclic structure formed of a plurality of ring structures connected to each other via any of a single bond, a vinylene bond and an ethynylene bond and a condensed polycyclic structure, and substituent groups attached to the ring structure at the ends of the polycyclic structure, at least one of the substituent groups being an organic group having a hydrocarbon chain. When used in combination with ban electron-donating color former, the developer formed of an LC-type compound should have an acidic substituent group. On the other hand, when used in combination with an electron-accepting color former, the developer formed of an LC-type compound should have a basic substituent group.

The noncondensed polycyclic structure consisting of a plurality of ring structures connected to each other via any of a single bond, a vinylene bond and a ethynylene bond or condensed polycyclic structure is known to the art as a mesogen group of a liquid crystal molecule. In other words, an LC-type compound adapted for use as a developer can be obtained by selecting appropriately the substituent groups attached to the ends of the mesogen group. It is possible for a halogen atom or an alkyl group to be substituted for a hydrogen atom in the vinylene bond. It is particularly desirable to use an LC-type compound having a polycyclic structure consisting of a plurality of ring structures which are connected to each other via an ethynylene bond, because the particular LC-type compound exhibits a high thermal stability and forms a supercooled liquid phase of a low viscosity. On the other hand, it is undesirable for a plurality of ring structures to be connected to each other via linkage groups other than a single bond, a vinylene bond and an ethynylene bond. In the case of using a linkage group which is likely to bring about a conformation change such as an alkylene bond, it is impossible to obtain a rigid mesogen group. Also, in the case of using a linkage group which is likely to be hydrolyzed such as an azo group, an azomethine group or an ester bond, the thermal stability is rendered insufficient.

In the LC-type compound described above, a large enthalpy change $\Delta H$ is provided between the metastable state of nonequilibrium and the state of equilibrium, because a large interaction is performed between the mesogen groups of the adjacent molecules. In addition, since substituent groups are attached to both ends of the mesogen group, the LC-type compound readily forms stably a state having a high degree of order. Further, since the mesogen group is very rigid and is small in its change of conformation, the enthalpy change is small when the degree of order of the molecules is enhanced. It follows that a particularly large free energy is not required in the process of change of the state from the state of nonequilibrium to the state of equilibrium. In other words, the potential barrier between the amorphous state and the crystalline state or between the two different states of phase separation can be lowered in the case of using a developer having the particular molecular structure described above, making it possible to bring about in a short time a change of state between the amorphous state and the crystalline state or between the two different states of phase separation.

The LC-type compound used as a developer in the present invention is represented by general formula (I) given below:

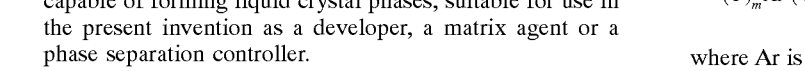

$$(Y)_m\text{Ar}(X)_n\text{R} \quad \text{(I)}$$

where Ar is a noncondensed polycyclic structure consisting of a plurality of ring structures connected to each other via any of a single bond, a vinylene bond and ethynylene bond or a condensed polycyclic structure; X is an ether bond, a thioether bond, an ester bond or an amide bond; Y is an acidic substituent group; R is a substituted or unsubstituted alkyl group, a substituted or unsubstituted alkenyl group or a substituted or unsubstituted alkynyl group; m is an integer of 1 to 3, and n is 0 or 1.

In the above formula, Y and R are substituent groups which are attached to the ring structures at the ends of the polycyclic structure.

The ring structure included in the compound represented by general formula (I) may be either an aromatic ring or a saturated ring. Also, the ring structure may contain a hetero atom. Where the ring structure forms a hetero ring, a large intermolecular interaction takes place, with the result that a state having a high degree of order can be formed easily when the compound is heated. To be more specific, Ar in general formula (I) denotes a noncondensed polycyclic structure or a condensation polycyclic structure. The noncondensed polycyclic structure consists of aromatic rings such as benzene rings or saturated rings having structural formulas exemplified below, said aromatic rings or saturated rings being connected to each other via a single bond, a vinylene bond or an ethynylene bond:

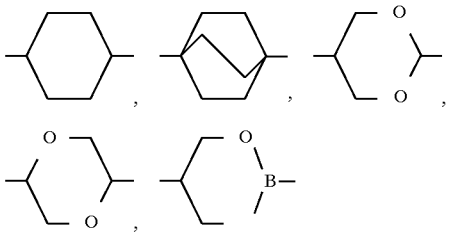

On the other hand, the condensed polycyclic structure includes, for example, a naphthalene ring, an azulene ring, an indene ring, a biphenylene ring, an anthracene ring, a fluorene ring, and a phenanthrene ring.

The LC-type compound having a saturated ring is generally advantageous in forming a liquid crystal phase having a low viscosity. In the case of using such an LC-type compound as a developer, the diffusion speed of the color former is increased so as to increase the phase separation speed between the developer and the color former. Particularly preferred is an LC-type compound having a cyclohexane ring because a liquid crystal phase having a low viscosity can be formed. LC-type compounds having other saturated rings are also preferred because these LC-type compounds permit imparting a high heat resistance to the recording material.

The LC-type compounds represented by general formula (I), which are used as a developer in the present invention, has a highly crystalline noncondensed polycyclic structure or condensed polycyclic structure, which is included in the molecular skeleton, and exhibits a high melting point. Naturally, these LC-type compounds permit improving the thermal stability of recording. The noncondensation polycyclic structure is preferred because the compound having a noncondensed polycyclic structure can easily form a liquid crystal phase. Also, it is desirable for the noncondensation polycyclic structure to have at least one aromatic ring, because the resultant compound is enabled to exhibit a high melting point. It is particularly desirable for the noncondensed polycyclic structure to have at least one p-phenylene ring which is rich in linearity and small in polarization, because the resultant compound is enabled to form a liquid crystal phase quite easily. To be more specific, the polycyclic structures effective in the present invention include, for example, a polycyclic structure consisting of a plurality of p-phenylene rings which are connected to each other via a single bond, a vinylene bond or an ethynylene bond, and a polycyclic structure consisting of at least one p-phenylene ring and any of the saturated rings shown in the above formula, which are connected to each other via a single bond, a vinylene bond or an ethynylene bond. Incidentally, a condensed polycyclic structure forming a rigid mesogen group is effective for improving the heat resistance of the recording material.

It is particularly desirable for X included in general formula (I) to represent an ether bond or a thioether bond, which is thermally stable and is unlikely to be decomposed by, for example, water. Further, the compound in which X represents an ester bond or an amide bond is substantially free from problems depending on the use of the resultant recording medium and is advantageous in that the LC-type compound can be synthesized easily and at a low cost. Y in general formula (I) represents an acidic substituent group. Since phenols are preferred for use as a developer in the present invention as already described, Y should desirably be a hydroxyl group. Further, phenol group as Y may be connected to the polycyclic structure via a linkage group such as an ester group. The additional acidic groups represented by Y include, for example, a phosphoric group and a sulfonic group.

R in general formula (I) represents a hydrocarbon chain having 1 to 30 carbon atoms, preferably 4 to 22 carbon atoms. If the hydrocarbon chain is unduly long, the enthalpy change is increased when the degree of order of the molecules is enhanced, with the result that a large activation free energy is required for the change of state from the state of nonequilibrium to the state of equilibrium. Incidentally, linear alkyl derivatives tend have a lower melting point with decrease in the length of the hydrocarbon chain. It follows that, if a linear alkyl derivative having a short hydrocarbon chain, which has a low melting point, is added to the composition forming the recording material, the thermal stability of the resultant recording medium is lowered. However, the compound represented by general formula (I) exhibits a sufficiently high melting point even if R has 10 or less carbon atoms, because the compound has a noncondensed polycyclic structure or a condensed polycyclic structure, which is included in the molecular skeleton. It follows that the thermal recording material containing the above-noted compound exhibits a sufficiently high thermal stability of recording. Where R represents a perfluoroalkyl group or a perfluoroalkylene group, the rigidity of the molecule is improved, with the result that the compound, when heated, is enabled to form a state having a high degree of order easily and stably. It is also desirable to use compounds of general formula (I), in which R represents a branched hydrocarbon group. Where, for example, a compound, in which R represents a branched alkyl group having two branches each having a long chain, is used as a developer, these long branches are twisted about each other so as to improve the thermal stability under the amorphous state. In addition, the crystallization speed is increased.

The molecular arrangement in the liquid crystal phase formed by the LC-type compound, i.e., compound capable of forming a liquid crystal phase, is not particularly limited in the present invention. If a smectic phase is formed in the case of using an LC-type compound as a developer, a phase separation of the recording material is facilitated because of a high degree of order, leading to a high contrast ratio between the color-developed state and the decolored state. On the other hand, where a nematic phase is formed, the diffusion speed of the color former within the developer is increased because of the low viscosity, leading to a high phase separation speed.

The LC-type compounds suitable for use as a matrix agent include, for example, steroid derivatives forming a cholesteric phase, compounds having a plurality of alkyl groups attached to a rigid aromatic ring and forming a discotic phase, and compounds forming a smectic phase or a nematic phase and having both a rigid mesogen group and a flexible hydrocarbon chain. Where the liquid crystal phase formed by the particular matrix agent assumes a smectic phase or discotic phase each having a high degree of order, the phase separation of the recording material is facilitated so as to improve the contrast ratio between the color-developed state and the decolored state. Also, where the particular liquid crystal phase assumes a nematic phase or a cholesteric phase each having a low viscosity, the diffusion speed of the color former within the developer is increased so as to markedly increase the phase separation speed between the color former and the developer.

The steroid derivatives effective for forming the cholesteric phase include, for example, a halide of cholesterol, monocarboxylic acid cholesterol ester, monocarboxylic acid sitosterol ester, and cholesterol ester of benzoic acid derivatives. To be more specific, these sterol derivatives include, for example, cholesteryl chloride, cholesteryl acetate, cholesteryl nonanate, methyl cholesteryl carbonate, ethyl cholesteryl carbonate, cholesteryl p-methoxy benzoate, sitosteroyl benzoate, sitosteroyl p-methyl benzoate, and cholestanyl benzoate.

The compounds forming a discotic phase, which have a plurality of alkyl groups attached to a rigid aromatic ring, are represented by general formulas (IIA) and (IIB) given below:

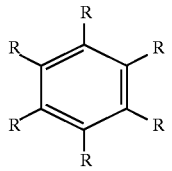

(IIA)

where R represents n—$C_mH_{2m+1}$—COO—, in which m is an integer of 3 to 20;

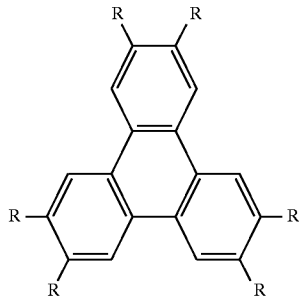

(IIB)

where R represents n—$C_mH_{2m+1}$—COO—, n—$C_mH_{2m+1}$—O—, or

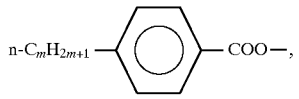

in which m is an integer of 3 to 20.

The LC-type compounds adapted for use in the present invention as a phase separation controller are represented by general formula (III) given below:

$$(Z)_m\text{—Ar}\text{—}(X)_n\text{—R} \quad \text{(III)}$$

where Ar is a noncondensed polycyclic structure consisting of a plurality of ring structures which are connected to each other via any of a single bond, a vinylene bond or an ethynylene bond or condensation polycyclic structure; X is an ether bond, a thioether bond, an ester bond or an amide bond; Z is a neutral polar group; R is a substituted or unsubstituted alkyl group, a substituted or unsubstituted alkenyl group, a substituted or unsubstituted alkynyl group, or a substituted or unsubstituted aryl group; m is an integer of 1 to 3; and n is 0 or 1.

In the rewritable thermal recording medium of the present invention, it is important to pay attentions to the glass transition temperature Tg of the recording material. If the glass transition temperature Tg is low, i.e., about room temperature, the phase separation or crystallization of the recording material, which is caused by the diffusion of the color former or the developer, is likely to be brought about by a slight elevation of the ambient temperature, with the result that the thermal stability of recording tends to be lowered. It follows that it is necessary for the recording material, in which an amorphous phase is formed in the entire region or in a portion, to have a glass transition temperature Tg of at least 25° C., preferably at least 50° C. In view of this requirement, it is desirable to use as a color former a compound having a bulky molecular skeleton close to, for example, a spherical form, having a large molecular weight and being small in its enthalpy change of melting ΔH. A compound having a plurality of sites at which intermolecular hydrogen bonds can be formed is also adapted for use as a color former in the present invention.

By contraries, in the case of using a recording material having a glass transition temperature Tg close to, for example, room temperature, it is possible to provide a rewritable thermal recording medium which permits the recorded information to be naturally erased after storage in the recording medium for a predetermined period of time. Further, where the recording medium is used for a special purpose, it is possible to use a recording material having a glass transition temperature Tg lower than room temperature. As such a special purpose, it may be possible to display the change in the color-developed state in the case where a temporary temperature elevation takes place in a refrigerator during transportation of the refrigerator which houses materials requiring refrigeration.

On the other hand, where the recording material has an unduly high glass transition temperature Tg, a large energy is required for heating the recording material to temperatures falling within a range of between the crystallization temperature Tc and the melting point Tm or to temperatures higher than the melting point Tm in the step of recording-erasing information, resulting in failure to achieve an energy saving. It follows that it is desirable for the recording material used in the present invention to have a glass transition temperature Tg not higher than 150° C.

It is generally known to the art that a mixture exhibits a glass transition temperature close to a weight average value of the glass transition temperatures of the components of the mixture. Therefore, in order to set the glass transition temperature Tg of the recording material used in the present invention at a desired value, it is desirable for the compound used as each of the color former, the developer, and the matrix agent to exhibit a glass transition temperature not lower than 25° C., preferably not lower than 50° C. Further, in view of the thermal stability of recording, it is desirable to use a matrix agent having a melting point of at least 100° C.

It is possible to use, for example, a differential scanning calorimeter (DSC) for measuring the glass transition temperature Tg in respect of the entire recording material and each of the components of the recording material. It is also possible to measure the glass transition temperature Tg for a portion of the recording material by using a DSC.

On the other hand, where a component compound of the recording material is likely to form an amorphous phase having a clear glass transition temperature Tg, the relationship Tg=a.Tm (where a is 0.65 to 0.8) is generally known to reside between the glass transition temperature Tg (absolute temperature) and the melting point Tm (absolute temperature) of the component compound. It follows that, if the glass transition temperature Tg of each of the components of the recording material is set at a high value, the melting point Tm of the recording material is rendered high. In this case, the thermal stability of recording can be improved. However, it is necessary to heat the recording material to high temperatures for melting the recording material. It follows that it is necessary to use a substrate having a high heat resistance, making it difficult to put the recording medium to practical use. In order to overcome this difficulty, it is effective to use a recording material capable of forming a plurality of crystal forms. For preparing a recording material capable of forming a plurality of crystal shapes, it is desirable to use a developer or a matrix agent capable of forming a plurality of crystal forms.

Let us describe preferred mixing ratio of the color former, the developer, the matrix agent, and the phase separation controller in the rewritable thermal recording medium of the present invention.

Where the recording material of the present invention contains a color former and a developer, but does not contain a matrix agent, the developer should be used in an amount of 0.1 to 100 parts by weight, preferably 1 to 10 parts by weight, relative to 1 part by weight of the color former. If the amount of the developer is smaller than 0.1 part by weight, it is difficult to increase sufficiently the interaction between the color former and the developer in the recording or erasing step. On the other hand, if the mixing amount of the developer is larger than 100 parts by weight, the color density tends to be lowered under the color-developed state.

Where the recording material contains a color former, a developer and a matrix agent, the developer should be used in an amount of 0.1 to 10 parts by weight, preferably 1 to 2 parts by weight, relative to 1 part by weight of the color former. If the amount of the developer is smaller than 0.1 part by weight, it is difficult to increase sufficiently the interaction between the color former and the developer in the recording or erasing step. On the other hand, if the mixing amount of the developer exceeds 10 parts by weight, it is difficult to decrease sufficiently the interaction between the developer and the color former in the recording or erasing time.

It is desirable to use the matrix agent in an amount of 1 to 200 parts by weight, preferably 10 to 100 parts by weight, relative to 1 part by weight of the color former. If the amount of the matrix agent is smaller than 1 part by weight, it is difficult to cause the transition between the crystalline state and the amorphous state or the change in the state of the phase separation. If the amount of the matrix agent exceeds 200 parts by weight, however, the color density in the color developing step is lowered.

Further, it is desirable to use the phase separation controller in an amount of 0.1 to 100 parts by weight, preferably 1 to 50 parts by weight, relative to 1 part by weight of the color former. If the amount of the phase separation controller is smaller than 0.1 part by weight, a satisfactory improvement cannot be obtained in the phase separation speed of the recording material. If the amount exceeds 100 parts by weight, however, the state of nonequilibrium of the recording material is rendered unstable, with the result that the thermal stability of recording tends to be lowered.

In the rewritable thermal recording medium of the present invention, it is possible to add, as required, a pigment, a fluorescent dye, an ultraviolet absorber, a heat insulating agent, a heat accumulating agent, etc. to the recording material consisting of the color former, the developer, the matrix agent and the phase separation controller. If, for example, a pigment is selected appropriately in view of the color former contained in the recording material, it is possible to obtain a desired colored state in each of the color-developed state and the decolored state.

In order to use the rewritable thermal recording medium of the present invention in the form of a bulk, a recording material containing the particular components described previously is melted in a solventless condition for the mixing purpose, followed by solidifying the recording material by a rapid cooling or a natural cooling. A recording medium of a desired shape can be obtained by shaping the molten recording material by using a mold. It is also possible to obtain a recording medium in the form of a thin film by expanding the molten recording material to form a thin layer. A recording medium in the form of a thin film can also be obtained by dissolving the recording material in a suitable solvent, followed by casting the resultant solution. It is desirable for the thin film thus formed to have a thickness of 0.5 to 50 $\mu$m. If the film is unduly thin, the resultant rewritable thermal recording medium tends to fail to develop color in a sufficiently high density. If the film is unduly thick, however, a large heat energy is required in the recording-erasing step, making it difficult to perform the recording-erasing operation at a high speed.

In order to improve the mechanical strength of the rewritable thermal recording medium of the present invention, it is possible to have the recording material used in the present invention supported by a suitable medium. For example, the recording material may be impregnated in a polymer sheet, may be dispersed in a binder polymer, may be dispersed in an inorganic glass, may be impregnated in a porous substrate, may be intercalated in a layered material, or may be encapsulated.

In order to allow a polymer sheet to be impregnated with the recording material of the present invention, a polymer sheet having inner spaces large enough to hold the recording material is impregnated with the recording material melted in the absence of a solvent or a solution prepared by dissolving the recording material in a suitable solvent. In view of the uniformity of the surface of the resultant rewritable thermal recording medium, it is desirable to use a polymer having a high wettability with the molten recording material or the solution. The specific polymers used in the present invention include, for example, polyether-ether ketones; polycarbonates; polyallylates; polysulfones; ethylene tetrafluoride resins; ethylene tetrafluoride copolymers such as an ethylene tetrafluoride-perfluoro alkoxyethylene copolymer, an ethylene tetrafluoride-perfluoroalkyl vinyl ether copolymer, ethylene tetrafluoride-propylene hexafluoride copolymer, and an ethylene tetrafluoride-ethylene copolymer; ethylene chloride trifluoride resins; vinylidene fluoride resins; fluorine-containing polybenzoxazoles; polypropylenes; polyvinyl alcohols; polyvinylidene chlorides; polyesters such as polyethylene terephthalate, polybutylene terephthalate, and polyethylene naphthalate; polystyrenes; polyamides such as Nylon 66; polyimides; polyimidoamides; polyether sulfones; polymethylpentenes; polyether imides; polyurethanes; polybudatienes; celluloses such as methyl cellulose, ethyl cellulose, cellulose acetate and nitrocellulose; gelatins; gum arabic; and papers such as neutral paper and acidic paper. It is particularly desirable to use celluloses and neutral paper because these media can be easily impregnated with the molten recording material or the solution of the recording material of the present invention. In addition, the resultant rewritable thermal recording medium is enabled to exhibit a high color density under the color developed state and a low residual color density under the decolored state.

For dispersing the recording material of the present invention in a binder polymer, a molten recording material or a solution of the recording material of the present invention is dispersed together with the binder polymer and additional components, as required, by various dispersion methods. The resultant dispersion may be coated on a suitable substrate.

The binder polymers used in the present invention include, for example, polyethylenes; chlorinated polyethylenes; ethylene copolymers such as ethylene-vinyl acetate copolymer, ethylene-acrylic acid-maleic anhydride copolymer; polybutadienes; polyesters such as polyethylene terephthalate, polybutylene terephthalate, and polyethylene naphthalate; polypropylenes; polyisobutylenes; polyvinyl chlorides; polyvinylidene chlorides; polyvinyl alcohols; polyvinyl acetals; polyvinyl butylals; tetrafluoroethylene resins; trifluorochloroethylene resins; ethylene fluoride-propylene resins; vinylidene fluoride resins; vinyl fluoride resins; tetrafluoroethylene copolymers such as tetrafluoroethylene-perfluoroalkoxyethylene copolymer, tetrafluoroethylene-perfluoroalkyl vinyl ether copolymer, tetrafluoroethylene-hexafluoro propylene copolymer and tetrafluoroethylene-ethylene copolymer; fluoro resins such as fluorine-containing polybenzoxazol; acrylic resins; methacrylic resins such as polymethyl methacrylate; polyacrylonitriles; acrylonitrile copolymers such as acrylonitrile-butadiene-styrene copolymer; polystyrenes; halogenated polystyrenes; styrene copolymers such as styrene-methacrylic acid copolymer and styrene-acrylonitrile copolymer; acetal resins; polyamides such as Nylon 66; gelatin; gum arabic; polycarbonates; polyester carbonates; cullulose-based resins; phenol resins; urea resins; epoxy resins; unsaturated polyester resins; alkyd resins; melamine resins; polyurethanes; diallyl phthalate resins; polyphenyleneoxides; polyphenylenesulfides; polysulfones; polyphenylsulfones; silicone resins; polyimides; bismaleimide triazine resins; polyimidoamide resins; polyether sulfones; polymethyl pentenes; polyether ether ketones; polyether imides; polyvinyl carbazols; and thermoplastic resins such as norbornene-based amorphous polyolefins.

The dispersion methods used in the present invention include, for example, a mixer method, a sand mill method, a ball mill method, an impeller mill method, a colloid mill method, a three roll mill method, a kneader method, a two roll method, a Banbury mixer method, a homogenizer method and a nanomizer method. These dispersion methods can be selected appropriately in view of the viscosity of the molten recording material or solution of the recording material, as well as the use and type of the rewritable thermal recording medium. Further, the coating methods for coating a substrate with the recording material of the present invention include, for example, a spin coating method, a draw-up coating method, an air doctor coating method, a blade coating method, a rod coating method, a knife coating method, a squeeze coating method, an impregnation coating method, a reverse roll coating method, a transfer coating method, a gravure coating method, a kiss roll coating method, a cast coating method, a spray coating method, a curtain coating method, a calender coating method, an extrusion coating method and an electrostatic coating method. These coating methods can also be selected appropriately in view of the use and type of the rewritable thermal recording medium aimed at.

Where the recording material forming a recording medium of the present invention is dispersed in a binder polymer, the binder polymer should be used in an amount of 0.01 to 100 parts by weight, preferably 0.05 to 20 parts by weight, relative to 1 part by weight of the matrix agent. If the amount of the binder polymer is smaller than 0.01 part by weight, it is impossible to improve sufficiently the mechanical strength of the resultant recording medium. If the amount of the binder polymer exceeds 100 parts by weight, however, the color density in the color developed state of the recording medium tends to be lowered.

Where the recording material forming the recording medium of the present invention is allowed to be supported by an inorganic glass, it is desirable to use an inorganic glass manufactured by a so-called sol-gel method. In this case, it is desirable for the gelling temperature not to be unduly high. Further, the porous substrates which can be used in the present invention include, for example, various inorganic compounds. On the other hand, the stratifying materials which can be used in the present invention include, for example, mica, clay mineral, talc and chlorite.

For preparing microcapsules having the recording material of the present invention wrapped therein, it is possible to employ an interfacial polymerization method, an in-situ polymerization method, an in-liquid hardening covering method, a phase separation method from an aqueous solution system, a phase separation from an organic solution system, an in-gas suspension method, and a spray drying method. These methods can be properly chosen depending on the use and type of the rewritable thermal recording medium aimed at. The materials used in the present invention for forming the shell of the microcapsule include, for example, condensation polymers such as melamine resins, epoxy resins, urea resins, phenol resins, and furan resins; thermosetting resins such as styrene-divinyl benzene copolymer and methyl acrylate-vinyl acrylate copolymer, which are crosslinked in three dimensional directions; and thermoplastic resins which have already been exemplified as binder polymers in which the recording material of the present invention is dispersed. It is possible to form a shell of multi-layer structure by using a plurality of different resins selected from the thermosetting resins and the thermoplastic resins exemplified above. In this case, it is desirable to use a thermosetting resin for forming the outermost layer of the shell of the microcapsule in order to improve the thermal stability of the microcapsule. It is also possible to disperse the resultant microcapsules in the binder polymer or the inorganic glass exemplified above. It should be noted that, even if the recording material itself is unlikely to be dispersed sufficiently in the supporting medium such as the inorganic glass, a satisfactory dispersion can be obtained in the case of dispersing the microcapsules in the supporting medium.

How to use the rewritable thermal recording medium of the present invention is not particularly limited. For example, the recording medium can be used as a bulk, in combination with a supporting medium such as fibers, or in the form of a thin film formed on a suitable substrate. Of course, the thin film noted above acts as a recording layer. The substrate on which a thin film of the recording material is formed in the present invention includes, for example, plastic films such as a polyethylene terephthalate film, a plastic plate, a metal plate, a semiconductor substrate, a glass plate, a wooden plate, a paper sheet, and an OHP sheet. It is also possible to coat the substrate with the microcapsules described previously, which are converted into a paint or an ink, followed by drying the paint or the ink, as required. In this case, different kinds of color formers can be wrapped in different microcapsules so as to achieve a desired color development easily. It is also possible to mix at a desired mixing ratio microcapsules containing different types of color formers, having different crystallization temperature Tc or different melting points Tm, and differing from each other in the state exhibited by the nonequilibrium state, i.e., whether the nonequilibrium state exhibits a color-developed state or decolored state. In this case, the colored state can be controlled in accordance with the magnitude of a supplied thermal energy. It follows that a full-color recording using color formers of, e.g., cyan, magenta and yellow can be achieved.

In the rewritable thermal recording medium of the present invention, it is also possible to form a protective layer on the recording layer made of a thin film of the recording material specified in the present invention for improving the durability of the recording layer or preventing the recording layer from being stuck to a thermal printer head (TPH) used for supplying a heat energy to the recording layer. The materials of the protective layer include, for example, a wax, a thermoplastic resin, a thermosetting resin, a photocurable resin, a water-soluble resin, and a latex. The thickness of the protective layer should desirably be 0.1 to 100 $\mu$m. Further, the protective layer may be allowed to contain additives such as a mold release agent, a lubricant, a heat-resistant material, and an antistatic agent. To be more specific, the recording layer may be coated with a dispersion or solution containing these additives together with the recording material specified in the present invention, followed by drying the coating to form the particular protective layer. Alternatively, a heat resistant film having an adhesive coated thereon in advance may be bonded to the recording layer by a dry laminate method to form the protective layer in question. Further, it is desirable to form an undercoat layer between the substrate and the recording layer in order to improve the bonding strength between the substrate and the recording layer and to improve the solvent resistance of the recording medium.

The heat resistant films used in the present invention are not particularly limited as far as the film has a thermal deformation temperature higher than the melting point of the recording material used as a recording material. For example, high molecular compounds can be used for forming these heat resistant films, including polyether-ether ketones; polycarbonates; polyallylates; polysulfones; tetrafluoroethylene resins; tetrafluoroethylene copolymers such as tetrafluoroethylene-perfluoro alkoxyethylene copolymer, tetrafluoroethylene-hexafluoropropylene copolymer, and tetrafluoro ethylene-ethylene copolymer; trifluorochloroethylene resins; vinylidene fluoride resins; fluorine-containing polybenzoxazoles; polypropylenes; polyvinyl alcohols; polyvinylidene chlorides; polyesters such as polyethylene terephthalate, polybutylene terephthalate, and polyethylene naphthalate; polystyrenes; polyamides such as Nylon 66; polyimides; polyimidoamides; polyethersulfones; polymethylpentenes; polyether imides; polyurethanes; and polybutadienes. These high molecular materials can be selected appropriately in view of the use and type of the heat source and the resultant rewritable thermal recording medium. Further, the adhesives generally used in the dry laminate method can be used in the present invention including, for example, acrylic resins; phenoxy resins; ionomer resins; ethylene copolymers such as ethylene-vinyl acetate copolymer, and ethylene-acrylic acid-maleic anhydride copolymer; polyvinyl ethers; polyvinyl formals; polyvinyl butyrals; gelatin; gum arabic; polyesters; polystyrenes; styrene copolymers such as styrene-acrylic acid copolymer; vinyl acetate resins; polyurethanes; xylene resins; epoxy resins; phenolic resins; and urea resins.

In order to perform the recording-erasing in the rewritable thermal recording medium of the present invention on the basis of transition between the crystalline state and the amorphous state or the change in the state of phase separation, heat energies having two different values are supplied to the recording medium, as already described. Alternatively, two kinds of heat histories differing from each other in the cooling rate after the heating of the recording medium to temperatures higher than the melting point Tm are applied to the recording medium, as already described.

It is desirable to use a TPH (thermal printer head) or a laser beam as a heat source for supplying heat energies to the recording medium in the recording step. The TPH, which is not amazingly high in resolution, permits heating the rewritable thermal recording medium over a large area, and is advantageous in miniaturizing the apparatus. On the other hand, a laser beam easily permits a high density recording by diminishing the beam spot diameter, and also permits increasing the recording-erasing speed. In the case of using a laser beam, however, it is desirable to dispose a light absorbing layer having an absorption band in the wavelength of the laser beam or to allow the recording material to contain a compound having an absorption band in the wavelength of the laser beam, in order to enable a highly transparent amorphous recording material to absorb the laser beam efficiently.

Further, for supplying heat energies in the erasing step, it is desirable to use as a heat source a hot stamper or a heat roll which permits instantly heating the entire region of the rewritable thermal recording medium. For the cooling of the recording medium once heated, the natural cooling can be employed. Also, it is desirable to employ rapid cooling by using a cold stamper, a cold roller, an air cooling using a cold air stream, or a Peltrier device. Further, an overwriting can be achieved in the rewritable thermal recording medium of the present invention by using a plurality of TPH's differing from each other in the energy value or a plurality of laser beams differing from each other in the diameter of the beam spot.

Let us describe Examples of the present invention.

Example 1:

1.0 part by weight of CVL (Crystal Violet lactone) as a color former was mixed with 1.0 part by weight of a phenolic compound, as a developer, represented by chemical formula (1) given below, followed by dissolving the mixture in chloroform to obtain a homogeneous solution.

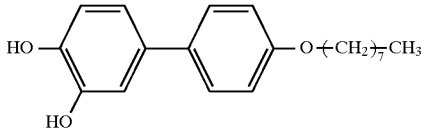

(1)

The solution was cast on a glass substrate 1.5 mm thick to form an amorphous thin film having a thickness of about 10 $\mu$m. The amorphous thin film was coated with an photocurable epoxy resin, followed by curing the resin film to obtain a protective film having a thickness of 1 $\mu$m. Then, a heat roll was pressed against the entire surface of the protective film, followed by subjecting to natural cooling. As a result, the amorphous thin film was crystallized so as to be turned white.

Figure 5:
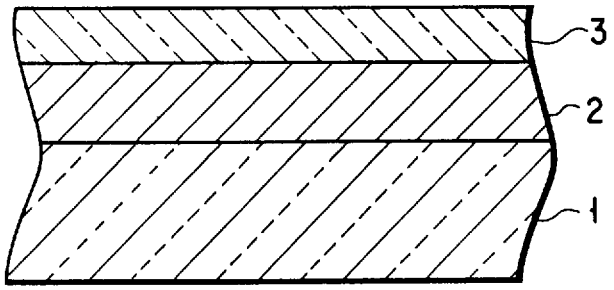
FIG. 5 is a vertical cross sectional view exemplifying the construction of a rewritable thermal recording medium of the present invention.

FIG. 5 is a cross sectional view showing the construction of the resultant thermal recording medium. As seen from the drawing, the thermal recording medium comprises a glass substrate 1, a thin film recording layer 2 formed on the substrate 1, and a protective film 3 formed on the recording layer 2.

A thermal printing was applied to the thermal recording medium by using a thermal head (6 dots/mm, 380Ω) manufactured by K.K. Toshiba. In this step, a voltage of 12 V with a pulse width of 0.8 millisecond was applied to the thermal head. As a result, the printed portion was turned amorphous and colored blue so as to achieve a positive recording. After the recording, the entire surface of the thermal recording medium was heated by using the same thermal head. In this step, a voltage of 10 V with a pulse width of 1.5 milliseconds was applied to the thermal head. As a result, the printed portion was brought back to the white crystalline state so as to erase the recorded information. On the other hand, a hot stamper was pressed for 0.1 second against the entire surface of another sample of the thermal recording medium after the recording step, followed by leaving the recording medium to stand at room temperature. The printed portion was brought back to the white crystalline state in this case, too, so as to erase the recorded information. No deterioration was recognized in the display even after 100 cycles of the recording-erasing operations described above. Further, no deterioration was recognized in the printed state even after the thermal recording medium was left to stand at 30° C. for one year.

Examples 2 to 21:

Various kinds of thermal recording media were prepared exactly as in Example 1, except that the color formers and the developers shown in Table 1 were used in these Examples. Each of PSD-V, PSD-290, PSG-3G and PED-150 used as a color former is a fluorane series leuco compound manufactured by Nippon Soda K.K. Also, IR (indolyl red) is a fluorane series leuco compound manufactured by Yamamoto Kasei K.K. On the other hand, chemical formula numbers of (2) to (16) shown in Table 1 as developers have chemical structures as given below:

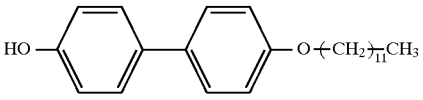
(2)

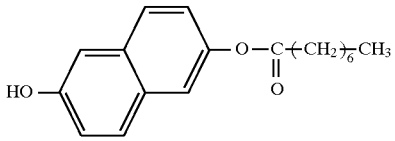
(3)

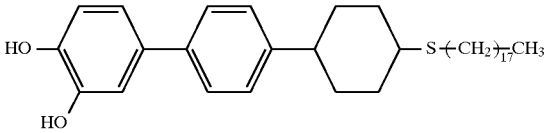
(4)

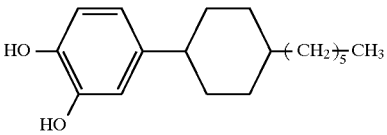
(5)

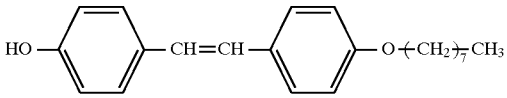
(6)

-continued

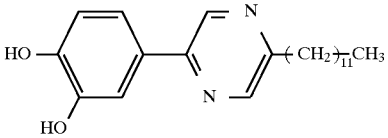
(7)

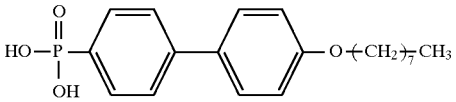
(8)

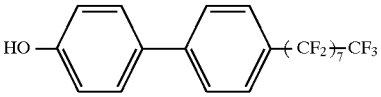
(9)

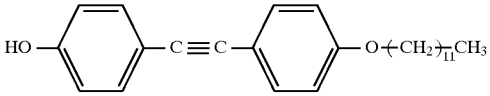
(10)

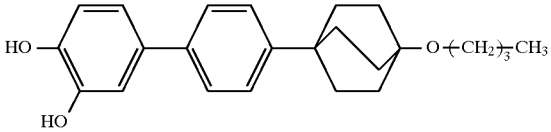
(11)

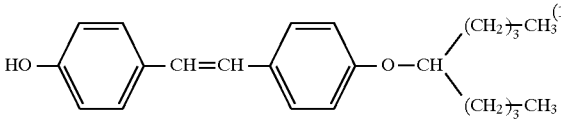
(12)

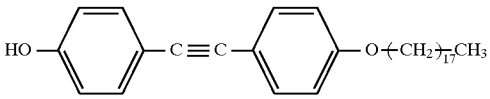
(13)

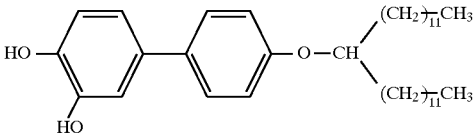
(14)

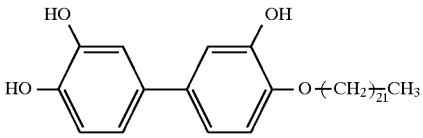
(15)

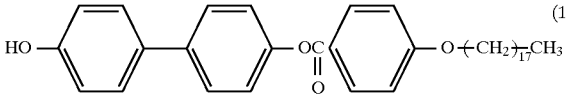
(16)

Recording-erasing was applied to each of the resultant thermal recording media as in Example 1 by using the thermal head equal to that used in Example 1. It has been found that a positive recording can be performed with a pulse width of 0.8 millisecond, and the erasing can be performed with a pulse width of 1.5 milliseconds. Table 1 also shows the voltages applied to the thermal head when information was recorded in and erased from each of the thermal recording media.

No deterioration was recognized in the display even after 100 cycles of the recording-erasing operations in each of these Examples 2 to 21, too. Further, no deterioration was recognized in the printed state even after the thermal recording medium was left to stand at 30° C. for one year.

TABLE 1

| Examples | Color Former | Developer (Chemical formula) | Thermal Head Voltage (V) Recording | Erasing |
|---|---|---|---|---|
| 2 | CVL | (2) | 13 | 10 |
| 3 | PSD-V | (1) | 12 | 10 |
| 4 | PSD-290 | (1) | 12 | 10 |
| 5 | CVL | (3) | 12 | 9.5 |
| 6 | CVL | (4) | 14 | 11 |
| 7 | IR | (1) | 12 | 10 |
| 8 | PSD-3G | (1) | 13 | 10.5 |
| 9 | CVL | (5) | 11 | 8 |
| 10 | CVL | (6) | 13 | 10 |
| 11 | CVL | (7) | 14 | 10.5 |
| 12 | CVL | (8) | 10 | 7.5 |
| 13 | CVL | (9) | 13 | 9.5 |
| 14 | CVL | (10) | 13 | 10 |
| 15 | CVL | (11) | 14 | 11 |
| 16 | PSD-3G | (11) | 14 | 11 |
| 17 | CVL | (12) | 13 | 9.5 |
| 18 | PSD-150 | (13) | 14 | 10 |
| 19 | PSD-150 | (14) | 14 | 10 |
| 20 | CVL | (15) | 13 | 9.5 |
| 21 | CVL | (16) | 13 | 9.5 |

Comparative Examples 1:

A thermal recording medium was prepared as in Example 1, except that a phenolic compound represented by the chemical formula (17) given below was used as a developer:

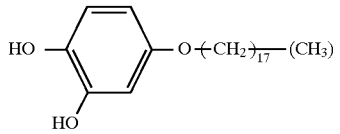

(17)

A thermal printing was applied to the resultant thermal recording medium by using the thermal head equal to that used in Example 1. A voltage of 13 V with a pulse width of 0.8 millisecond was applied to the thermal head for performing the recording operation. The printed portion was turned amorphous and colored blue so as to achieve a positive printing. However, when a hot stamper was pressed for 1 second against the entire surface of the thermal recording medium, followed by leaving the recording medium to stand at room temperature, the printed portion was brought back to the white crystalline state only partially. Erasing has been found to be incomplete in the case of using a developer which is incapable of forming a liquid crystal phase.

Example 22:

1.0 part by weight of CVL as a color former was mixed with 2.0 parts by weight of a phenolic compound represented by the chemical formula (2) given previously, followed by thermally melting the mixture to obtain a homogeneous composition acting as a recording material.

On the other hand, a chromium layer acting as a light absorbing layer was formed in a thickness of 100 nm by a vacuum vapor deposition on an optically polished glass substrate having a thickness of 1.2 mm. A small amount of the recording material composition was melted on the light absorbing layer formed on the glass substrate, followed by putting another glass plate on the melt such that the melt was sandwiched in the form of an expanded thin film between the two glass plates. Then, the glass substrate was cooled gradually to form a crystalline thin film, about 10 $\mu$m thick, acting as a recording layer, thereby preparing a thermal recording medium comprising a glass substrate, a light absorbing layer, a recording layer and a glass plate.

Information was written in the recording layer of the resultant thermal recording medium by irradiating the thermal recording medium, which was kept rotated at 900 rpm, with a semiconductor laser light having a wavelength of 830 nm and converged to have a diameter of 1 $\mu$m such that the intensity of the laser light was 6 mW on the surface of the recording medium. When observed with a polarizing microscope, the written portion, i.e., laser light-irradiated portion, was found with a high contrast ratio to have been turned amorphous. Specifically, a linear recording with a line width of about 1 $\mu$m was clearly recognized. After the recording, the thermal recording medium, which was kept rotated at 900 rpm, was irradiated again with a semiconductor laser light having a wavelength of 830 nm and converged to have a diameter of 2 $\mu$m such that the intensity of the laser light was 3 mW on the surface of the recording medium. When observed with a polarizing microscope, the region in which information was written previously, which was included in the region irradiated with the laser light of 3 mW, was found to have been turned crystalline, indicating that the recorded information was erased. Incidentally, no change was recognized in the written state when the recording medium having the information recorded therein by means of irradiation with 2 mW of the laser light was left to stand at 30° C. for one year.

Example 23:

1.0 part by weight of CVL as a color former was mixed with 2.0 parts by weight of a phenolic compound represented by the chemical formula (2) given previously, followed by thermally melting the mixture to obtain a homogeneous composition acting as a recording material. Further, 0.5 g of melamine prepolymer was added to 30 g of the composition noted above, followed by thermally melting the resultant composition. Then, the resultant melt was dripped into an aqueous solution containing 5% by weight of gelatin while stirring the solution to form fine droplets, followed by further stirring the solution for 5 hours at about 80° C., with the pH value of the solution controlled to be 2 with hydrochloric acid. As a result, formed was a suspension of microcapsules each consisting of a composition of the color former and the developer and a cured melamine resin covering the composition. The resultant microcapsule suspension was coated on a copying paper sheet, followed by drying and pressing a heat roll against the entire surface of the copying paper sheet. Then, the copying paper sheet was subjected to natural cooling at room temperature so as to form a recording layer on the surface of the paper sheet, said recording layer consisting essentially of the microcapsules containing a crystalline composition. Incidentally, the microcapsules separated from the suspension by filtration, followed by centrifugal separation, drying, etc. may also be used in the present invention.

A thermal printing was applied to the resultant thermal recording medium (copying paper sheet) by applying a voltage of 13 V with a pulse width of 1 millisecond to the thermal head equal to that used in Example 1. The printed portion was found to have been turned amorphous and colored blue, indicating that a positive printing was performed. Then, a hot stamper was pressed for 0.2 second against the entire surface of the copying paper sheet after the recording, followed by leaving the copying paper sheet to stand at room temperature. The printed portion was found to have been brought back to the crystalline phase so as to erase the recorded information. Incidentally, no change was recognized in the printed state even after the copying paper sheet was left to stand at 30° C. for one year.

Example 24:

1.0 part by weight of C.I. basic blue 3 as a color former was mixed with 4.0 parts by weight of a benzene sulfonic acid derivative represented by the chemical formula (18) given below:

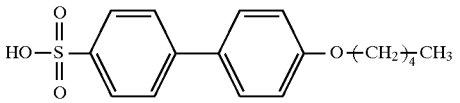

(18)

The resultant mixture was thermally melted to form a homogeneous molten composition. It should be noted that a decolored state is formed with increase in the interaction between the color former and the developer. On the other hand, a color-developed state is formed with decrease in the interaction between the two.

A small amount of the resultant composition was melted on a glass substrate 1.5 mm thick. On the other hand, a glass plate, 1 mm thick, having a small amount of spacers consisting of silica particles each having a diameter of 10 μm deposited thereon was disposed on the glass substrate such that the melt in the form of a thin film was sandwiched between the two glass plates, followed by subjecting the substrate to natural cooling at room temperature. When the glass plate was removed, a transparent amorphous thin film was found to have been formed on the glass substrate in a thickness of about 10 μm. Then, the amorphous thin film was coated with a photocurable epoxy resin, followed by curing the resin to form a protective layer having a thickness of 1 μm. Further, a heat roll was pressed against the entire surface of the protective layer, followed by natural cooling at room temperature so as to crystallize the amorphous thin film and, thus, to form a blue recording layer.

A thermal printing was applied to the resultant thermal recording medium by applying a voltage of 13 V with a pulse width of 1 millisecond to the thermal head equal to that used in Example 1. The printed portion was found to have been turned amorphous and colorless, indicating that a negative printing was performed. Then, a hot stamper was pressed for 0.2 second against the entire surface of the thermal recording medium after the recording, followed by leaving the recording medium to stand at room temperature. The printed portion was found to have been brought back to the blue crystalline state so as to erase the recorded information. Recording-erasing was repeated similarly, with the result that no deterioration of display was recognized after 100 cycles of the recording-erasing operation. Also, no change was recognized in the printed state even after the recording medium was left to stand at 30° C. for one year.

Example 25:

A thermal recording medium was prepared as in Example 24, except that 1.0 part by weight of cyanine dye as a color former was mixed with 2.0 parts by weight of a phosphorus compound, as a developer, represented by the chemical formula (19) given below:

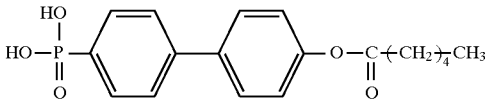

(19)

It should be noted that a decolored state is formed with increase in the interaction between the color former and the developer in this Example, too. Likewise, a color-developed state is formed with decrease in the interaction between the two.

A thermal printing was applied to the resultant thermal recording medium by applying a voltage of 13 V with a pulse width of 0.8 millisecond to the thermal head equal to that used in Example 1. The printed portion was found to have been turned amorphous and colorless, indicating that a negative printing was performed. Then, a hot stamper was pressed for 0.2 second against the entire surface of the thermal recording medium after the recording, followed by leaving the recording medium to stand at room temperature. The printed portion was found to have been brought back to the blue crystalline phase so as to erase the recorded information. Recording-erasing was repeated similarly, with the result that no deterioration of display was recognized after 100 cycles of the recording-erasing operation. Also, no change was recognized in the printed state even after the recording medium was left to stand at 30° C. for one year.

Example 26:

1.0 part by weight of CVL as a color former, 1.0 part by weight of a phenolic compound, as a developer, represented by the chemical formula (2) given previously, and 0.5 part by weight of stearyl alcohol as a phase separation controller were mixed with each other, followed by preparing a thermal recording medium as in Example 1.

A thermal printing was applied to the resultant thermal recording medium by applying a voltage of 12 V with a pulse width of 0.8 millisecond to the thermal head equal to that used in Example 1. The printed portion was found to have been turned amorphous and colored blue, indicating that a positive printing was performed. Then, the entire surface of the thermal recording medium after the recording was heated by applying a voltage of 9 V with a pulse width of 1.2 milliseconds to the same thermal head. As a result, the printed portion was brought back to the white crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 27:

1.0 part by weight of CVL as a color former was mixed with 1.0 part by weight of a phenolic compound represented by the chemical formula (20) given below:

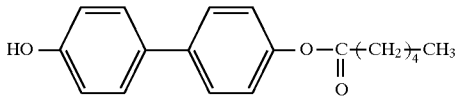

(20)

The resultant mixture was dissolved in chloroform to obtain a homogeneous solution. The developer used was found to be capable of forming a liquid crystal phase (smectic phase) in a supercooled liquid of 92 to 110° C. by combination of a differential scanning calorimetry and a polarizing microscope. The solution was cast on a glass substrate 1.5 mm thick to form an amorphous thin film about 10 μm thick. Then, the amorphous thin film was coated with a photocurable epoxy resin, followed by curing the resin to form a protective film 1 μm thick. Further, a heat roll was pressed against the entire surface of the protective film, followed by natural cooling at room temperature so as to crystallize the amorphous thin film and, thus, to turn the thin film white.

A thermal printing was applied to the resultant thermal recording medium by applying a voltage of 12 V with a pulse width of 0.8 millisecond to the thermal head equal to that used in Example 1. The printed portion was found to have been turned amorphous and colored blue, indicating that a positive printing was performed. Then, the entire surface of the thermal recording medium after the recording was heated by applying a voltage of 9 V with a pulse width of 1 millisecond to the same thermal head. As a result, the printed portion was brought back to the white crystalline state, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 28:

A thermal recording medium was prepared as in Example 27, except that a phenolic compound represented by the chemical formula (21) given below was used as a developer:

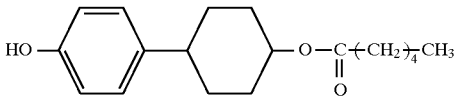

(21)

The developer used was found to be capable of forming a liquid crystal phase (nematic phase) in a supercooled liquid of 63° to 87° C. by combination of a differential scanning calorimetry and a polarizing microscope.

A thermal printing was applied to the resultant thermal recording medium by applying a voltage of 11 V with a pulse width of 0.8 millisecond to the thermal head equal to that used in Example 1. The printed portion was found to have been turned amorphous and colored blue, indicating that a positive printing was performed. Then, the entire surface of the thermal recording medium after the recording was heated by applying a voltage of 9 V with a pulse width of 1 millisecond to the same thermal head. As a result, the printed portion was brought back to the white crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 29:

A thermal recording medium was prepared as in Example 27, except that a phenolic compound represented by the chemical formula (22) given below was used as a developer:

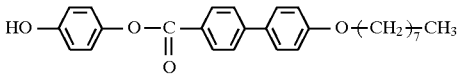

(22)

The developer used was found to be capable of forming a liquid crystal phase (nematic phase) in a supercooled liquid of 165° to 180° C. by combination of a differential scanning calorimetric analysis and a polarizing microscope.

A thermal printing was applied to the resultant thermal recording medium by applying a voltage of 15 V with a pulse width of 0.8 millisecond to the thermal head equal to that used in Example 1. The printed portion was found to have been turned amorphous and colored blue, indicating that a positive printing was performed. Then, the entire surface of the thermal recording medium after the recording was heated by applying a voltage of 11 V with a pulse width of 1 millisecond to the same thermal head. As a result, the printed portion was brought back to the white crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 30:

1.0 part by weight of CVL as a color former, 1.0 part by weight of a phenolic compound, used as a developer, represented by the chemical formula (23) given below, and 10 parts by weight of β-sitosterol derivative, used as a matrix agent, represented by the chemical formula (24) were mixed with each other:

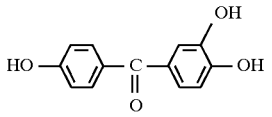

(23)

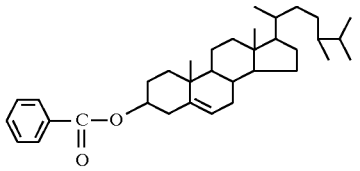

(24)

The resultant mixture was dissolved in chloroform to prepare a homogeneous solution. Incidentally, the developer used is not covered by the general formula (I) given previously. The matrix agent used was found to be capable of forming a liquid crystal phase (cholesteric phase) in a supercooled liquid by combination of a differential scanning calorimetrcy and a polarizing microscope.

The resultant solution was cast on a glass substrate 1.5 mm thick to form an amorphous thin film about 10 μm thick. Then, the amorphous thin film was coated with a photocurable epoxy resin, followed by curing the resin to form a protective film. Further, a heat roll was pressed against the entire surface of the protective film, followed by natural cooling at room temperature so as to crystallize the amorphous thin film and, thus, to turn the thin film white.

A thermal printing was applied to the resultant thermal recording medium by applying a voltage of 12 V with a pulse width of 0.8 millisecond to the thermal head equal to that used in Example 1. The printed portion was found to have been turned amorphous and colorless, indicating that a negative printing was performed. Then, the entire surface of the thermal recording medium after the recording was heated by applying a voltage of 8.5 V with a pulse width of 1 millisecond to the same thermal head. As a result, the printed portion was brought back to the blue crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 31:

A thermal recording medium was prepared as in Example 30, except that a compound represented by the chemical formula (25) given below was used as a matrix agent:

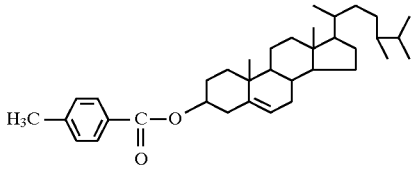

(25)

The matrix agent used was found to be capable of forming a liquid crystal phase (smectic phase) in a supercooled liquid by combination of a differential scanning calorimetry and a polarizing microscope.

A thermal printing was applied to the resultant thermal recording medium by applying a voltage of 13 V with a pulse width of 0.8 millisecond to the thermal head equal to that used in Example 1. The printed portion was found to have been turned amorphous and colorless, indicating that a negative printing was performed. Then, the entire surface of the thermal recording medium after the recording was heated by applying a voltage of 9 V with a pulse width of 1 millisecond to the same thermal head. As a result, the printed portion was brought back to the blue crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 32:

1.0 part by weight of CVL as a color former, 1.0 part by weight of a phenolic compound, as a developer, represented by the chemical formula (23) given previously, 10 parts by weight of β-sitosterol derivative, as a matrix agent, represented by the chemical formula (24) given previously, and 5 parts by weight of eicosanol as a phase separation controller were mixed with each other, followed by preparing a thermal recording medium as in Example 30.

A thermal printing was applied to the resultant thermal recording medium by applying a voltage of 11 V with a pulse width of 0.8 millisecond to the thermal head equal to that used in Example 1. The printed portion was found to have been turned amorphous and colorless, indicating that a negative printing was performed. Then, the entire surface of the thermal recording medium after the recording was heated by applying a voltage of 8 V with a pulse width of 0.8 millisecond to the same thermal head. As a result, the printed portion was brought back to the blue crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 33:

A thermal recording medium was prepared as in Example 32, except that 10 parts by weight of cholesterol was used as a matrix agent, and 7 parts by weight of a compound represented by the chemical formula (26) given below was used as a phase separation controller:

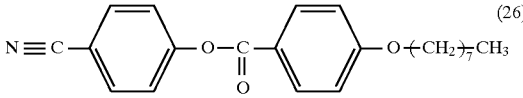

(26)

The phase separation controller used was found to be capable of forming liquid crystal phases (both smectic phase and nematic phase) by combination of a differential scanning calorimetry and a polarizing microscope.

A thermal printing was applied to the resultant thermal recording medium by applying a voltage of 11 V with a pulse width of 0.8 millisecond to the thermal head equal to that used in Example 1. The printed portion was found to have been turned amorphous and colorless, indicating that a negative printing was performed. Then, the entire surface of the thermal recording medium after the recording was heated by applying a voltage of 8.5 V with a pulse width of 1 millisecond to the same thermal head. As a result, the printed portion was brought back to the blue crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 34:

A thermal recording medium was prepared as in Example 32, except that a compound represented by the chemical formula (27) given below was used as a phase separation controller:

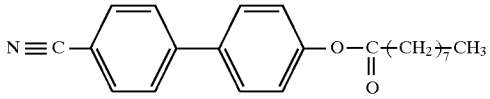

(27)

The phase separation controller used was found to be capable of forming liquid crystal phases (both smectic phase and nematic phase) by combination of a differential scanning calorimetry and a polarizing microscope.

A thermal printing was applied to the resultant thermal recording medium by applying a voltage of 11 V with a pulse width of 0.8 millisecond to the thermal head equal to that used in Example 1. The printed portion was found to have been turned amorphous and colorless, indicating that a negative printing was performed. Then, the entire surface of the thermal recording medium after the recording was heated by applying a voltage of 8.2 V with a pulse width of 1 millisecond to the same thermal head. As a result, the printed portion was brought back to the blue crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 35:

1.0 part by weight of phenolphthalein as a color former was mixed with 1.0 part by weight of an amino compound represented by the chemical formula (28) given below:

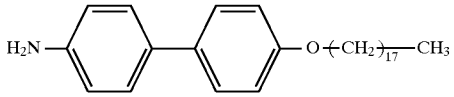

(28)

The resultant mixture was dissolved in chloroform to obtain a homogeneous solution. The solution was cast on a glass substrate 1.5 mm thick to form an amorphous thin film about 10 μm thick. Then, the amorphous thin film was coated with a photocurable epoxy resin, followed by curing the resin to form a protective film 1 μm thick. Further, a heat roll was pressed against the entire surface of the protective film, followed by natural cooling at room temperature so as to crystallize the amorphous thin film and, thus, to turn the thin film white.

A thermal printing was applied to the resultant thermal recording medium by applying a voltage of 12 V with a pulse width of 0.8 millisecond to the thermal head equal to that used in Example 1. The printed portion was found to have been colored red, indicating that a positive printing was performed. Then, the entire surface of the thermal recording medium after the recording was heated by applying a voltage of 10 V with a pulse width of 1.5 milliseconds to the same thermal head. As a result, the printed portion was brought back to the white crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

Example 36:

1.0 part by weight of CVL (Crystal Violet lactone) as a color former, 1.0 part by weight of a phenolic compound, as a developer, represented by the chemical formula (17) given previously, and 0.3 part by weight of a compound, as a phase separation controller capable of forming a liquid crystal phase, said compound represented by the chemical formula (29) given below were mixed with each other:

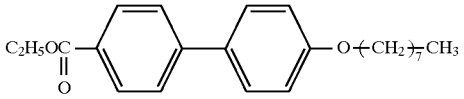

(29)

The resultant mixture was dissolved in chloroform to obtain a homogeneous solution. The solution was cast on a glass substrate 1.5 mm thick to form an amorphous thin film about 10 μm thick. Then, the amorphous thin film was coated with a photocurable epoxy resin, followed by curing the resin to form a protective film 1 μm thick. Further, a heat roll was pressed against the entire surface of the protective film, followed by natural cooling at room temperature so as to crystallize the amorphous thin film and, thus, to turn the thin film white.

A thermal printing was applied to the resultant thermal recording medium by applying a voltage of 12 V with a pulse width of 0.8 millisecond to the thermal head equal to that used in Example 1. The printed portion was found to have been colored blue, indicating that a positive printing was performed. Then, the entire surface of the thermal recording medium after the recording was heated by applying a voltage of 10 V with a pulse width of 1.5 milliseconds to the same thermal head. As a result, the printed portion was brought back to the white crystalline phase, indicating that the recorded information was erased. Recording-erasing was repeated similarly, with the result that no deterioration of display was recognized after 100 cycles of the recording-erasing operation. Also, no change was recognized in the printed state even after the recording medium was left to stand at 30° C. for one year.

What is claimed is:

1. A rewritable thermal recording medium, comprising a recording material containing a color former and a developer, wherein said developer has a polycylis structure selected from the group consisting of a noncondensed polycyclic structure formed of a plurality of ring structures connected to each other via any of a single bond, a vinylene bond and an ethynylene bond and a condensed polycyclic structure, and substituent groups attached to the ring structures at the ends of said polycyclic structure, at least one of said substituent groups being an organic group having a hydrocarbon chain.

2. The rewritable thermal recording medium according to claim 1, wherein the substituent group attached to said developer has an acidic group or a basic group.

3. The rewritable thermal recording medium according to claim 1, wherein said developer is formed of a compound represented by general formula (I) given below:

$$(Y)_m\text{—Ar—}(X)_n\text{—R} \qquad \text{(I)}$$

wherein Ar denotes a noncondensed polycyclic structure consisting of a plurality of ring structures connected to each other via any of a single bond, a vinylene bond, and an ethynylene bond or a condensation polycyclic structure; X denotes an ether bond, a thioether bond, an ester bond or an amide bond; Y denotes an acidic group; R denotes a substituted or unsubstituted alkyl group, a substituted or unsubstituted alkenyl group, or a substituted or unsubstituted alkynyl group; m is an integer of 1 to 3; and n is 0 or 1.

4. The rewritable thermal recording medium according to claim 3, wherein the compound represented by general formula (I) is capable of forming a liquid crystal phase.

5. The rewritable thermal recording medium according to claim 3, wherein R included in general formula (I) denotes a branched hydrocarbon group.

6. The rewritable thermal recording medium according to claim 1, wherein recording-erasing of information is performed on the basis of at least one of the reversible transition between a crystalline state and an amorphous state and a change in the phase separation state.

7. A rewritable thermal recording medium, comprising at least a color former, a developer, and a phase separation controller serving to increase the phase separation speed, wherein said phase separation controller is formed of a compound represented by a general formula (III) given below:

$$(Z)_m\text{—Ar—}(X)_n\text{—R} \qquad \text{(III)}$$

wherein Ar denotes a noncondensed polycyclic structure consisting of a plurality of ring structures connected to each other via any of a single bond, a vinylene bond, an ethylene bond or a condensed polycyclic structure; X denotes an ether bond, a thioether bond, an ester bond or an amide bond; Z denotes a neutral polar group; R denotes a substituted or unsubstituted alkyl group, a substituted or unsubstituted alkenyl group, a substituted or unsubstituted alkynyl group; m is an integer of 1 to 3; and n is 0 or 1.

8. The rewritable thermal recording medium according to claim 7, wherein said phase separation controller is formed of a compound capable of forming a liquid crystal phase at 25° C. or higher.

9. The rewritable thermal recording medium according to claim 7, further comprising a matrix material.

10. The rewritable thermal recording medium according to claim 9, wherein said phase separation controller is formed of a compound capable of forming a liquid crystal phase at 25° C. or higher.

11. The rewritable thermal recording medium according to claim 10, wherein said liquid crystal phase is selected from the group consisting of a cholesteric phase, a discotic phase, a smectic phase and a nematic phase.

12. A rewritable thermal recording medium comprising a recording material containing a color former and a developer, wherein said developer is formed of a compound represented by a general formula (I) given below:

$$(Y)_m\text{—Ar—}(X)_n\text{—R} \qquad \text{(I)}$$

wherein Ar denotes a noncondensed polycyclic structure consisting of a plurality of ring structures connected to each other via any of a single bond, a vinylene bond, an ethylene bond or a condensed polycyclic structure, X denotes an ether bond, a thioether bond, an ester bond or an amide bond; Y denotes a hydroxyl group, a phosphorus acid group or a sulfonic acid group; R denotes a substituted or unsubstituted alkyl group, a substituted or unsubstituted alkenyl group, or a substituted or unsubstituted alkynyl group; m is an integer of 2 or 3 in the case where Y is a hydroxyl group, and m is an integer of 1 to 3 in the case where Y is a phosphorus acid group or a sulfonic acid group; and n is 0 or 1.

13. The rewritable thermal recording medium according to claim 12, wherein said developer is capable of forming a liquid crystal phase at 25° C. or higher.

14. The rewritable thermal recording medium according to claim 13, wherein said liquid crystal phase is selected from the group consisting of a smectic phase and a nematic phase.

15. The rewritable thermal recording medium according to claim 12, wherein R denotes a branched hydrocarbon group.

16. The rewritable thermal recording medium according to claim 12, wherein R denotes a hydrocarbon group having 1 to 30 carbon atoms.

17. The rewritable thermal recording medium according to claim 12, wherein R denotes a hydrocarbon group having 4 to 22 carbon atoms.

* * * * *